US007837230B2

(12) United States Patent
Mellis et al.

(10) Patent No.: US 7,837,230 B2
(45) Date of Patent: Nov. 23, 2010

(54) HYBRID COMPONENT

(75) Inventors: Jeffrey Jay Mellis, Bloomfield Hills, MI (US); Frank Gabbianelli, Troy, MI (US); Erryn Leigh Langlois, Windsor (CA); Daniel Sulisz, Lake Orion, MI (US); Mark F. Werner, LaSalle (CA); Timothy W. Skszek, Saline, MI (US); Frank A. Horton, Rochester Hills, MI (US); Warren Young, Troy, MI (US); Seetarama S. Kotagiri, Rochester Hills, MI (US); P. Gregory Kiselis, Livonia, MI (US); Dewayne Dale Egle, Brighton, MI (US)

(73) Assignee: Magna International Inc., Aurora (CA)

( * ) Notice: Subject to any disclaimer, the term of this patent is extended or adjusted under 35 U.S.C. 154(b) by 790 days.

(21) Appl. No.: 10/576,377

(22) PCT Filed: Oct. 20, 2004

(86) PCT No.: PCT/US2004/034504

§ 371 (c)(1),
(2), (4) Date: Apr. 25, 2007

(87) PCT Pub. No.: WO2005/042188

PCT Pub. Date: May 12, 2005

(65) Prior Publication Data

US 2007/0271793 A1 Nov. 29, 2007

Related U.S. Application Data

(60) Provisional application No. 60/512,827, filed on Oct. 20, 2003, provisional application No. 60/612,800, filed on Sep. 27, 2004.

(51) Int. Cl.
*B62D 21/00* (2006.01)
*B62D 24/00* (2006.01)

(52) U.S. Cl. ..... 280/781; 280/93.511; 280/93.512; 280/124.135; 280/752

(58) Field of Classification Search ..... 280/781, 280/93.511, 93.512, 124.135, 124.134, 752; 180/274
See application file for complete search history.

(56) References Cited

U.S. PATENT DOCUMENTS 3,210,102 A * 10/1965 Joslin ..... 285/374

(Continued)

FOREIGN PATENT DOCUMENTS

EP 0 776 814 A 6/1997

*Primary Examiner*—Toan C To
(74) *Attorney, Agent, or Firm*—Harness, Dickey & Pierce, P.L.C.

(57) ABSTRACT

A hybrid component for lightweight, structural uses, including a steel member formed of a high strength steel; and a cast coupling member cast on a portion of the steel member by casting-in-place a semi-solid aluminum about the portion of the steel member, thereby positively and rigidly securing the coupling member to the steel member. A method of forming a hybrid component for lightweight, structural uses, including: forming a steel member formed of a high strength steel into a predetermined configuration; and casting a coupling member on a portion of the steel member by casting-in-place a semi-solid aluminum about the portion of the steel member, thereby positively and rigidly securing the coupling member to the steel member.

34 Claims, 23 Drawing Sheets

U.S. PATENT DOCUMENTS 4,633,931 A 1/1987 Yamaguchi et al.
5,338,057 A * 8/1994 Dickerson et al. ..... 280/124.134
5,613,794 A * 3/1997 Isaac et al. ..... 403/265
6,311,996 B1 * 11/2001 Kato et al. ..... 280/124.134
6,408,515 B1 * 6/2002 Durand ..... 29/897.2
6,464,240 B1 * 10/2002 Seksaria et al. ..... 280/495
6,654,995 B1 * 12/2003 Wang et al. ..... 29/421.1
6,935,657 B2 * 8/2005 Kondou et al. ..... 280/777
7,175,204 B2 * 2/2007 Tarbutton et al. ..... 280/785
7,399,942 B2 * 7/2008 Wang et al. ..... 219/93
2003/0038453 A1 * 2/2003 Seksaria et al. ..... 280/495
2009/0134594 A1 * 5/2009 Kiselis et al. ..... 280/124.134

* cited by examiner

HYBRID COMPONENT

The present invention is related to and claims priority from U.S. Provisional Patent Application 60/512,827 filed on Oct. 20, 2003, the entire contents being incorporated herein in its entirety. The present invention is also related to and claims priority from U.S. Provisional Patent Application 60/612,800 filed on Sep. 27, 2004, the entire contents being incorporated herein in its entirety.

BACKGROUND OF THE INVENTION

1. Field of the Invention

The present invention relates in general to an automotive component, and more specifically, to a hybrid component for use in an automobile suspension, chassis, body or power train component such as but not limited to control arm, engine mount, sub-frame or transmission pump that is at least partially formed by using a cast-in-place operation.

2. Description of the Related Art

Typically, a conventional arm member for use as an automobile suspension arm is comprised of a machined aluminum casting, iron casting or formed steel structure and a pair of elastomeric bushings pressed in each end of the member. In the case of a tubular formed steel structure, various fusion welding (MIG welding, TIG welding or laser welding), or friction agitation welding, have been developed to connect the coupling members to the tubular member at a joined portion. Known casting methods include those disclosed in U.S. Patent Nos. 5,332,026, 5,429,175, 5,660,223, 6,467,528, and 6,745,819, the entire contents being incorporated herein by reference.

However, a conventional suspension arm member, for example, in which the main body and the coupling member are joined by using a welding method, such as fusion welding (MIG welding, TIG welding, laser welding, or the like) or a solid-phase welding method (friction agitation welding), may cause cracks at or approximate to the joined portion when a tensile load is imparted thereto resulting in separation of the joined members and reduced functionality. Further, to achieve a reduction in mass of the connecting member, the connecting member may be tubular in shape. Conventionally, the connecting member and coupling members are of similar chemical composition or metallurgically compatible to permit use of a fusion welding process used to connect the members to achieve the strength and corrosion resistance requirements of the product. Thus, there is a need to provide a component for an automobile suspension, structure, body or power train application that is light in weight and void of potential quality issues related to strength, cracks and corrosion.

SUMMARY OF THE INVENTION

The inventors of the present invention has recognized these and other problems associated with conventional components. To alleviate such problems, an aspect of the invention relates to a method of forming a hybrid component that includes deforming an open end of a tubular member to seal the open end, and casting molten material about the deformed open end to form a coupling member.

The deforming step may further comprise crushing or pinching the open end to seal the open end. The deforming step may further comprise folding the sealed open end on itself to form a J-hook attachment feature. Also, the deforming step may further comprise folding the open end.

Another aspect of the invention relates to a method of forming a hybrid component that includes inserting a cap member into or around an open end of a tubular member, and casting molten material about the tubular member and cap member to form a coupling member.

The method may further comprise the steps of piercing the tubular member and an outer wall of the cap member, and inserting a pin into the pierced tubular member and cap member.

Another aspect of the invention relates to a hybrid component that includes a tubular member having a deformed open end, and a coupling member formed on the deformed open end of the tubular member by casting-in-place molten material about the deformed open end, thereby positively securing the coupling member to the tubular member.

The component may further comprise a plug partially received in the open end, and a pin received through holes formed in the tubular member and the plug.

Another aspect of the invention relates to a method that comprises the steps of rotary swedging the open end of a tubular member to seal the open end, and casting molten material about the deformed end to form a coupling member.

Another aspect of the invention relates to a method that comprises the steps of applying a nickel-based coating material onto the surface of the closed end of a tubular member to form a coupling member.

Another aspect of the invention relates to a hybrid component for lightweight, structural uses. The hybrid component includes a steel member formed of a high strength steel, and a cast coupling member cast on a portion of the steel member by casting-in-place a semi-solid aluminum about the portion of the steel member, thereby positively and rigidly securing the coupling member to the steel member.

The steel member may have a yield strength of at least about 1300 MPa, and the cast coupling may have a yield strength of at least about 180 MPa. The steel member may be a tubular member. The portion of the steel member on which the coupling member is cast may be an end portion of the tubular member. The end portion may include bent sections extending outwardly away from the steel member. The end portion may include a section having a non-circular cross-section. The portion of the steel member on which the coupling member is cast may be a mid portion of the tubular member. The mid portion may include a section having a non-circular cross-section.

Another aspect of the invention relates to an engine cradle for a motor vehicle. The engine cradle includes a frame assembly having a pair spaced rails secured by spaced cross members. At least one of the spaced rails and the spaced cross members include a hybrid component including a steel member formed of a high strength steel and a cast coupling member cast on a portion of the steel member by casting-in-place a semi-solid aluminum about the portion of the steel member, thereby positively and rigidly securing the coupling member to the steel member.

The steel member may have a yield strength of at least about 1300 MPa, and the cast coupling may have a yield strength of at least about 180 MPa. The steel member may be a tubular member.

Another aspect of the invention relates to a control arm for a motor vehicle. The control arm includes a hybrid component including a steel member formed of a high strength steel and curved in a longitudinal direction and cast coupling members cast on the steel member. Each of the coupling members are cast on a portion of the steel member by casting-in-place a semi-solid aluminum about the portion of the steel member, thereby positively and rigidly securing the coupling member to the steel member.

The steel member may have a yield strength of at least about 1300 MPa, and each of the cast couplings may have a yield strength of at least about 180 MPa. The steel member may be a tubular member.

Another aspect of the invention relates to an instrument panel support structure for a motor vehicle. The instrument panel support structure includes a hybrid component in the form of a cross beam and a mount positioned on each end of the hybrid component. The hybrid component includes a steel member formed of a high strength steel and a cast coupling member cast on the steel member. The coupling member is cast on a portion of the steel member by casting-in-place a semi-solid aluminum about the portion of the steel member, thereby positively and rigidly securing the coupling member to the steel member. The cast coupling member includes a plurality of spaced brackets.

The steel member may have a yield strength of at least about 1300 MPa, and the cast coupling may have a yield strength of at least about 180 MPa. The steel member may be a tubular member.

Another aspect of the invention relates to a bumper assembly for a motor vehicle. The bumper assembly includes a hybrid component including a steel member formed of a high strength steel and cast coupling members cast on the steel member. Each of the coupling members are cast on a portion of the steel member by casting-in-place a semi-solid aluminum about the portion of the steel member, thereby positively and rigidly securing the coupling members to the steel member. The steel member forms a longitudinally extending steel bumper member constructed to protect the vehicle from impact, and the coupling members form first and second aluminum members attached to the steel bumper member. The steel bumper member extends between the first and second aluminum members and the first and second aluminum members are positioned between the steel bumper member and the space frame of the vehicle.

The steel member may have a yield strength of at least about 1300 MPa, and each of the cast couplings may have a yield strength of at least about 180 MPa. The steel member may be a tubular member.

Another aspect of the invention relates to a method of forming a hybrid component for lightweight, structural uses. The method includes forming a steel member formed of a high strength steel into a predetermined configuration and casting a coupling member on a portion of the steel member by casting-in-place a semi-solid aluminum about the portion of the steel member, thereby positively and rigidly securing the coupling member to the steel member.

The forming the steel member may include forming the steel member to have a yield strength of at least about 1300 MPa, and the casting the cast coupling may include forming the aluminum to have a yield strength of at least about 180 MPa. The forming the steel member may include forming the steel member as a tubular member. The method may further comprise heat treating the hybrid component to an elevated temperature. Thee heat treating the hybrid component to an elevated temperature may include heat treating the hybrid component to approximately 440 degrees.

Another aspect of the invention relates to a bumper assembly for a vehicle. The bumper assembly includes a longitudinally extending steel bumper member constructed to protect the vehicle from impact, and first and second aluminum members attached to the steel bumper member. The steel bumper member extends between the first and second aluminum members and the first and second aluminum members are positioned between the steel bumper member and the space frame of the vehicle.

The first and second aluminum members may be mounting brackets having a mounting plate configured to mount the bumper member to the space frame. Also, the first and second aluminum members may be plates. Further, the first and second aluminum members may be crush cans configured to absorb a collision force and deform in predetermined manner.

Another aspect of the invention relates to a method of manufacturing a bumper assembly for a vehicle. The method includes forming a longitudinally extending steel bumper member constructed for protecting the vehicle from impact, forming first and second aluminum members, attaching the first and second aluminum members to the steel bumper member such that the steel bumper member extends between the first and second aluminum members, and the first and second aluminum members being positioned between the steel bumper member and the space frame of said vehicle.

The forming of the bumper member may include forming the bumper member by one of roll-forming, stamping, and hot stamping. Also, the forming of the first and second aluminum members may include forming the first and second aluminum members by extrusion. Further, the forming of the first and second aluminum members may include forming the first and second aluminum member with an aluminum portion and a steel portion. Additionally, the method may further comprise attaching a nonmetallic impact-absorption device to the steel member.

Another aspect of the invention relates to a bumper assembly for a vehicle. The bumper assembly includes longitudinally extending tubular members constructed to protect the vehicle from impact, and first and second mounting members attached to the tubular members to mount the tubular members to the space frame of the vehicle. The tubular members extend between the first and second mounting members and the first and second mounting members are positioned between the tubular members and the space frame of the vehicle.

The tubular members may include two substantially parallel tubular members. The mounting members may be aluminum and each of the mounting members filly encapsulates an end of each of the two tubular members. The bumper assembly may further comprise a middle member attached to and extending between the tubular members. The middle member may extend substantially along the entire length of the tubular members. The bumper assembly may further comprise a nonmetallic impact-absorption device attached to the tubular members. Also, each of the tubular members may be hollow.

Another aspect of the invention relates to a method of manufacturing a bumper assembly for a vehicle. The method includes forming a longitudinally extending bumper member constructed to protect the vehicle from impact, casting a first mounting member on a first end of the steel bumper member, and casting a second mounting member on a second end of the steel bumper member.

The forming a longitudinally extending bumper member may include forming a steel bumper member. The casting of the first and second mounting members may include casting aluminum mounting members. The method may further comprise attaching the first and second mounting members to the space frame of the vehicle. The method may further comprise attaching a nonmetallic impact-absorption device to the bumper member. The forming of the bumper member may include forming the bumper member by hydroforming. Also, the forming the bumper member may include forming the bumper member by roll-forming.

Another aspect of the invention relates to a method of manufacturing a bumper assembly for a vehicle. The method includes forming a first longitudinally extending tubular bumper member constructed to protect the vehicle from impact, casting a first mounting member on a first end of the first tubular bumper member, and casting a second mounting member on a second end of the first tubular bumper member.

The method may further comprise forming a second longitudinally extending tubular bumper member constructed to protect the vehicle from impact, and wherein the casting of the first and second mounting members may include casting the first mounting member on a first end of the second tubular bumper member and casting the second mounting member on a second end of the second tubular bumper member. The forming a longitudinally extending tubular bumper member may include forming a steel tubular bumper member. The casting of the first and second mounting members may include casting aluminum mounting members. The method may further comprise attaching the first and second mounting members to the space frame of the vehicle. The method may further comprise attaching a nonmetallic impact-absorption device to the bumper member. The forming the first tubular bumper member may include forming the tubular bumper member by hydroforming. The forming of the first tubular bumper member may include forming the tubular bumper member by roll-forming. Also, the forming of the first tubular bumper member may include forming a hollow tubular bumper member.

DETAILED DESCRIPTION OF ILLUSTRATED EMBODIMENTS

The subject application discloses a casting method employing a semi-solid casting process to fabricate structural components, e.g., automotive structural components, comprised of a preformed high strength steel insert and cast aluminum. The method involves placing a preformed and heat treated steel member, e.g., a tube, into a conventional steel die cast die, casting semi-solid aluminum around specific sections of the steel member, and creating a component comprised of dissimilar materials (e.g., steel and aluminum). The hybrid material (aluminum/steel) structural component may be subsequently heat treated (artificially aged at an elevated temperature of approximately 400 degrees F.) to a T5 heat treatment specification to improve the mechanical properties of the cast aluminum. Subsequent to the heat treatment process, the component may be machined and assembled using conventional processing and methods. (It should be understood that the reference to "steel" and "aluminum" are intended to encompass materials that include steel and aluminum, respectively, and to include various types of steel and aluminum being made of various elements.) Aluminum castings manufactured using the semi-solid casting process do not require a solution heat treatment cycle to achieve an acceptable yield strength, typically greater than 180 MPa. Semi-solid castings have yield strength greater than 180 MPa with merely an artificial aging (T5) heat treatment cycle, which involves exposing the aluminum casting to a temperature of 440 degrees F. (220 C).

Thus, the components of the subject application as described in the illustrated embodiments discussed below have the ability to be fabricated from a cast aluminum/steel hybrid component having a yield strength of a cast aluminum greater than about 180 MPa and a steel yield strength greater than about 1,300 MPa. This can be accomplished if the cast aluminum/steel hybrid component is not exposed to the aluminum solution heat treatment temperature (typically 1000 F). The semi-solid aluminum casting process provides the ability to obtain a minimum yield strength of 180 MPa by subjecting the hybrid component to a T5 artificial age heat treatment (typically 440° F.), this avoiding degradation of the steel material properties which results from "overtempering" during the aluminum solution heat treatment processing. Thus, the subject application discloses apparatus and methods that provide components that are relatively strong yet relatively lightweight.

Figure 1:
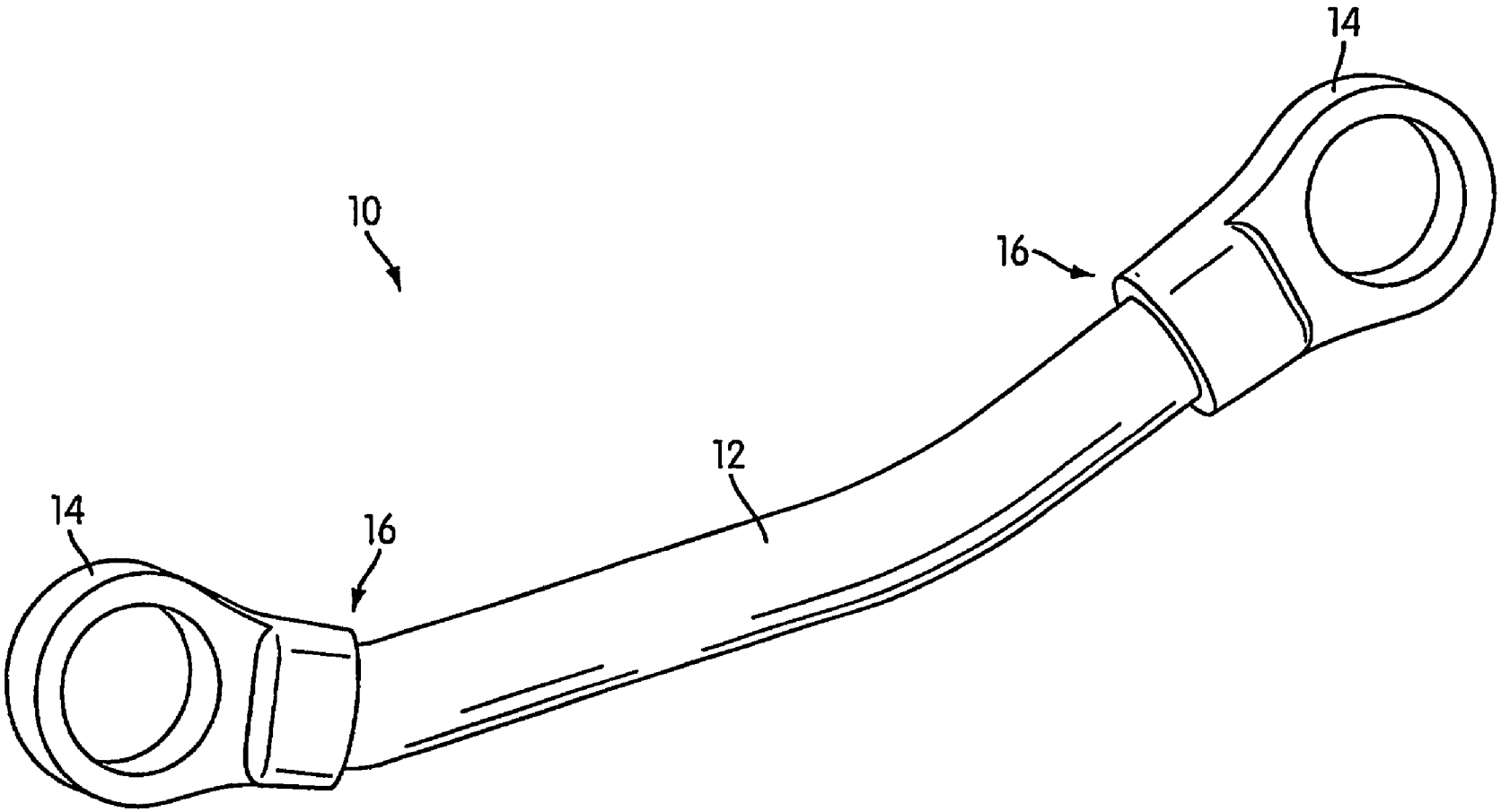
FIG. 1 is a perspective view of a hybrid component according to an embodiment of the invention.

Referring now to FIG. 1, a hybrid component 10 is shown according to an embodiment of the invention. In the illustrated embodiment, the hybrid component 10 can be used as a suspension arm 10 in a vehicle. The hybrid component 10 comprises a tubular member 12 made of a metal material, such as steel, aluminum, or the like. The tubular member 12 may be heat treated. The tubular member 12 can be formed to any desired shaped by using any conventional process. For example, the tubular member 12 can be formed using a hydroforming process, or the like, thereby forming a hydrocast hybrid component. The hybrid component 10 also includes a pair of substantially identical attachment or coupling members 14 made of aluminum die casting and connected to longitudinal opposite end portions 16 of the tubular member 12. As used herein, the term "aluminum" denotes aluminum and its alloys. A bushing 18 may be forcibly fitted into and secured by each coupling member 14, and a sleeve 20 may be fitted within the bushing 18, as shown in FIG. 2.

Figure 2:
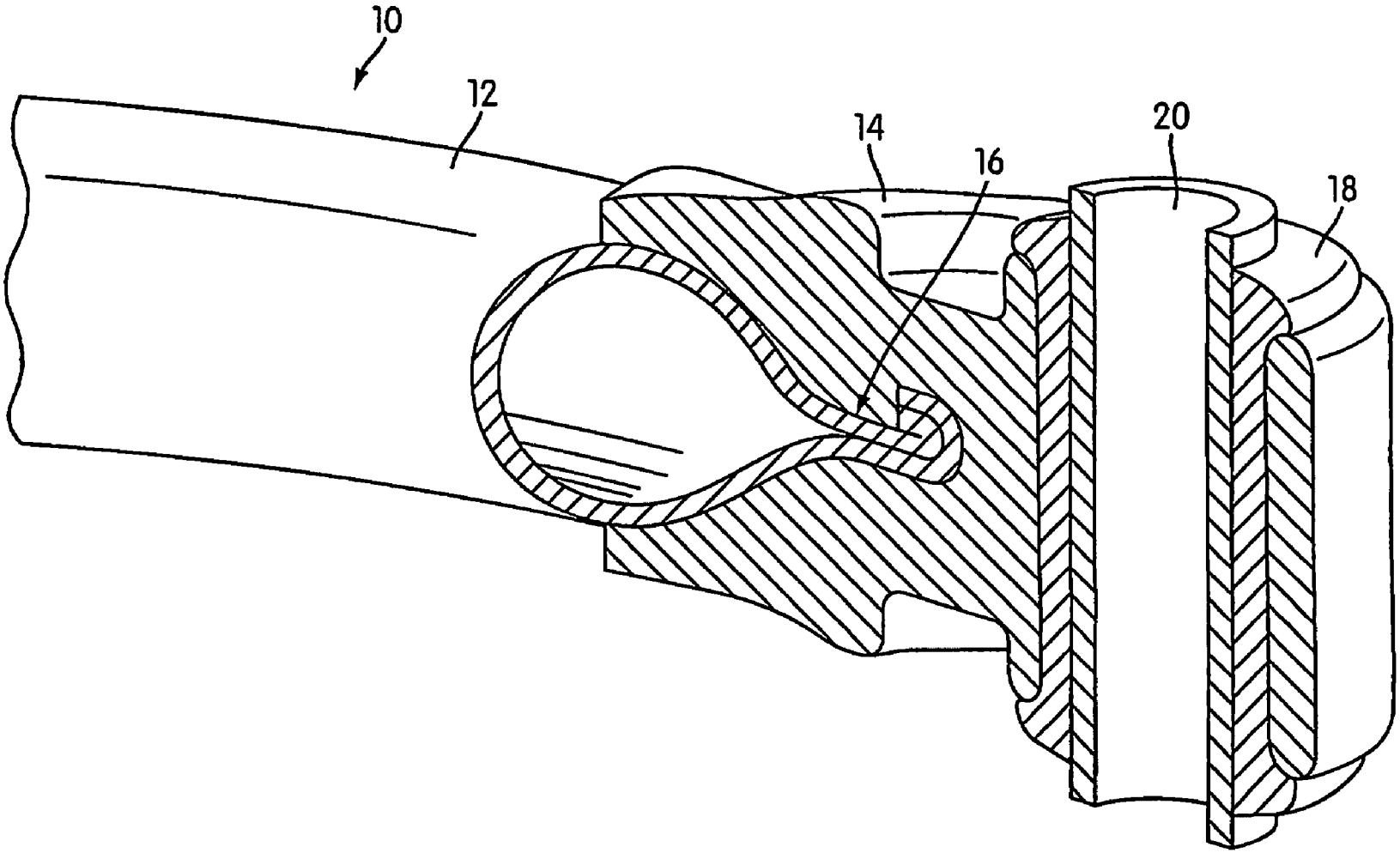
FIG. 2 is a partial cutaway view of a hybrid component according to an embodiment of the invention in which an end portion is crushed and folded over on itself to form a J-hook attachment feature.
Figure 3:
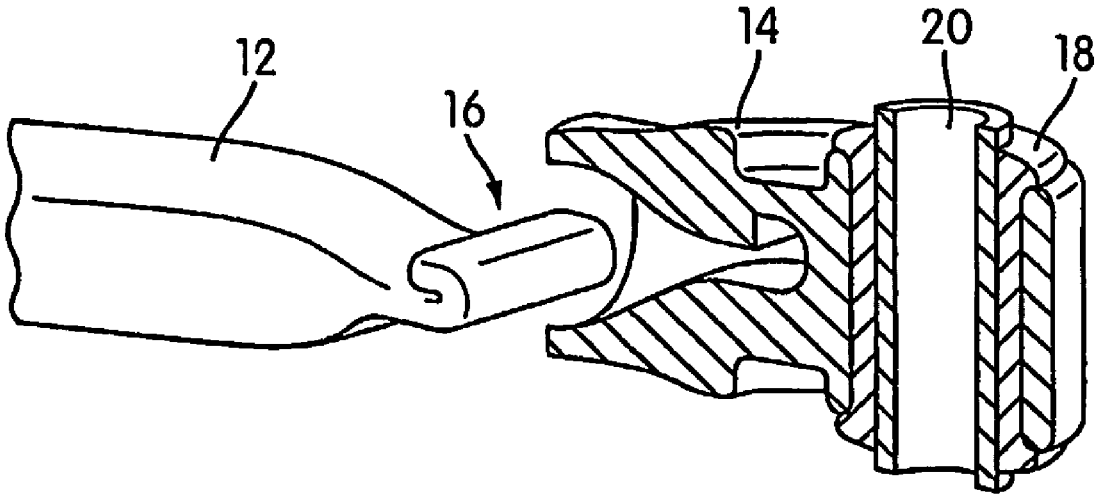
FIG. 3 is an exploded view of the hybrid component of FIG. 2.

Referring now to FIGS. 2 and 3, one aspect of the invention is the method in which the coupling member 14 is secured to the tubular member 12. Specifically, the invention contemplates a method of securing the coupling member 14 to the tubular member 12 using a cast-in-place technique, rather than using a conventional welding technique. The cast technology used to form the coupling member 14 can be, for example, high pressure aluminum die casting, low pressure permanent mold, lost foam casting, squeeze cast, vacuum die cast, semi-solid casting, or the like. As shown in FIGS. 2 and 3, one or both end portions 16 of the tubular member 12 is deformed by crushing or pinching such that the end portion 16 of the tubular member 12 is sealed to prevent the ingress or influx of the molten casting material into the tubular member 12 during the cast-in-place technique, and to eliminate any gaps between the tubular member 12 and each end portion 16. Also, the crush forming operation also distorts the shape of tubular member 12 and, thus, increases the torsional strength of the hybrid assembly. In addition, the end portion 16 is folded upon itself to form a J-hook attachment feature that provides a mechanical lock or joint between the coupling member 14 and the tubular member 12. In this manner, the coupling member 14 is positively secured to the tubular member 12. Also, the J-hook increases the tensile strength of the hybrid assembly. In addition, to increase the strength of the joint between the deformed tubular member 12 and the coupling member 14, single or multiple openings may be created in the deformed tubular member 12 using conventional drill, pierce or cutting processes which are filled with cast material during the cast-in place technique.

It should be understood that the form of the crushed ends of tubular member illustrated in the figures provides examples of crushed forms, but that the form and shape of the crushed ends can be tailored based upon the functional use of the part, such as the arm 10 and its function requirements.

Figure 4:
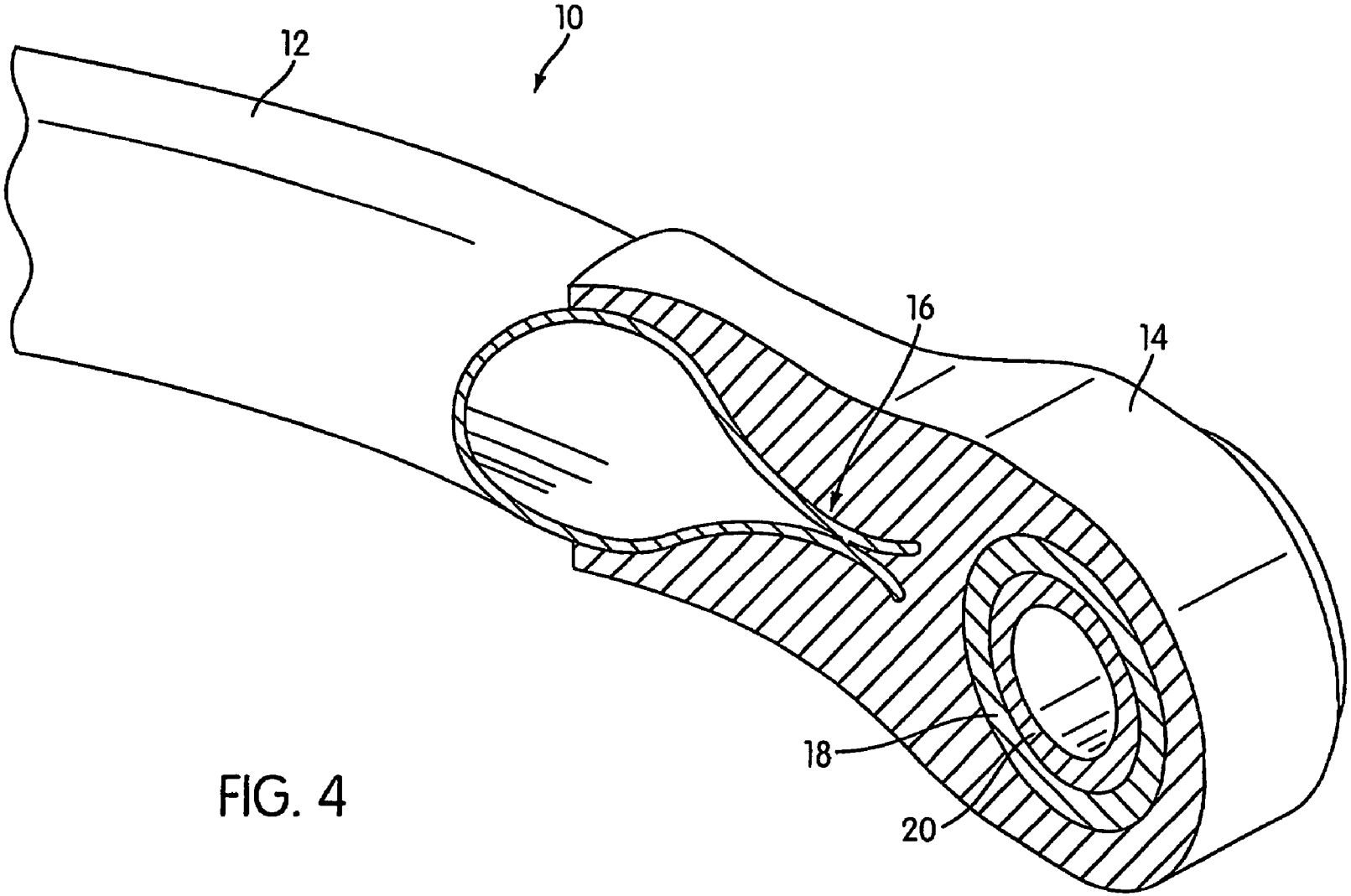
FIG. 4 is a partial cutaway view of a hybrid component according to an embodiment of the invention in which an end portion is crushed to form a Y-hook attachment member.

Referring now to FIG. 4, another embodiment of the invention is shown in which the cast-in-place coupling member 14 is secured to the tubular member 12. Specifically, the tubular member 12 is deformed by crushing the end portion 16 of the tubular member 12 to completely seal and prevent the ingress or influx of the molten casting material into the tubular member 12 during the cast-in-place technique. In addition, the end portion 16 is forms a Y-hook attachment feature that provides a mechanical lock or joint between the coupling member 14 and the tubular member 12. In this manner, the coupling member 14 is positively secured to the tubular member 12 and attachment between the end portion and the tubular member can be accomplished without crevices or openings between the two elements that could cause galvanic corrosion.

Figure 5:
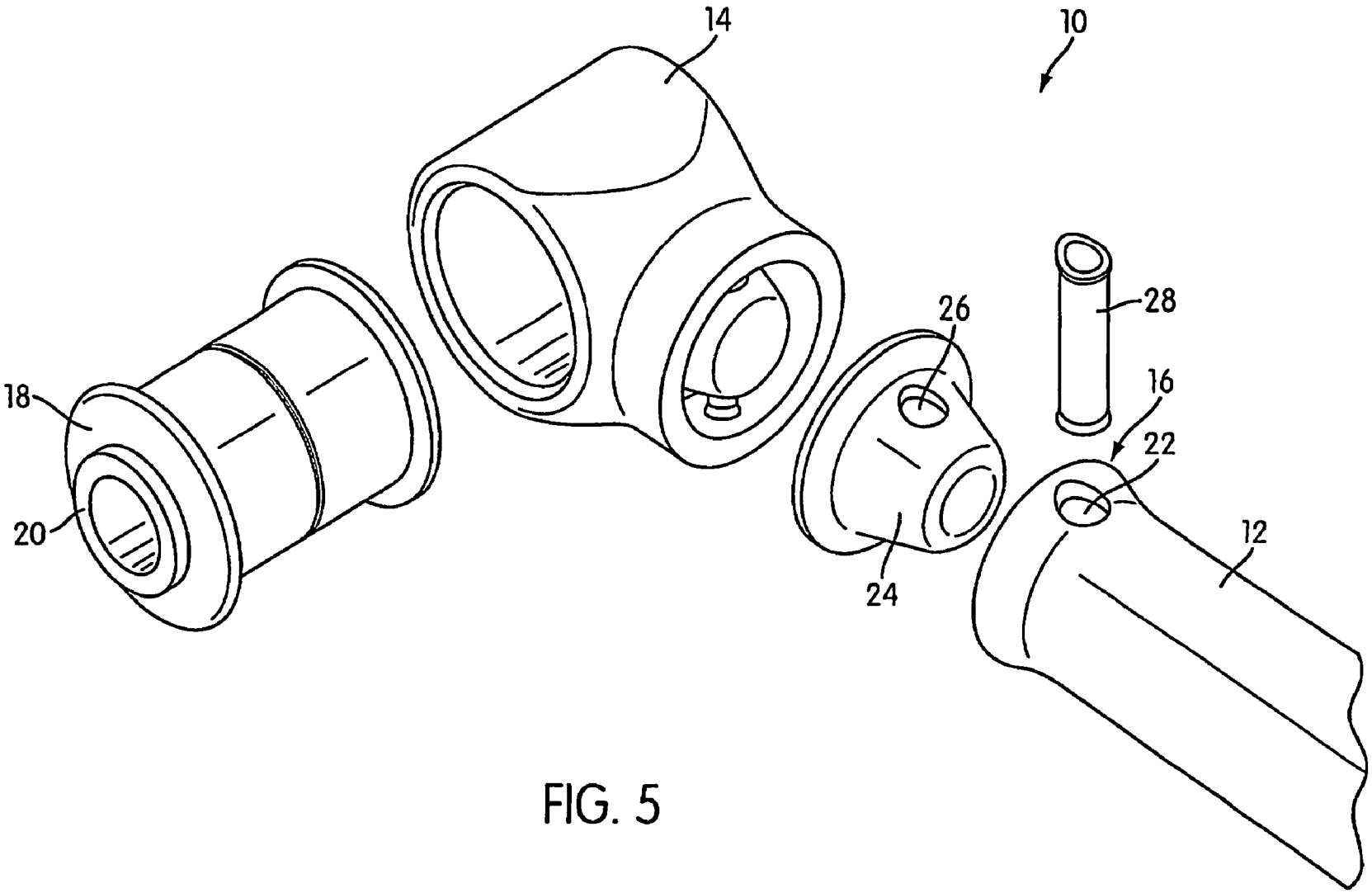
FIG. 5 is an exploded view of a hybrid component according to another embodiment of the invention.
Figure 6:
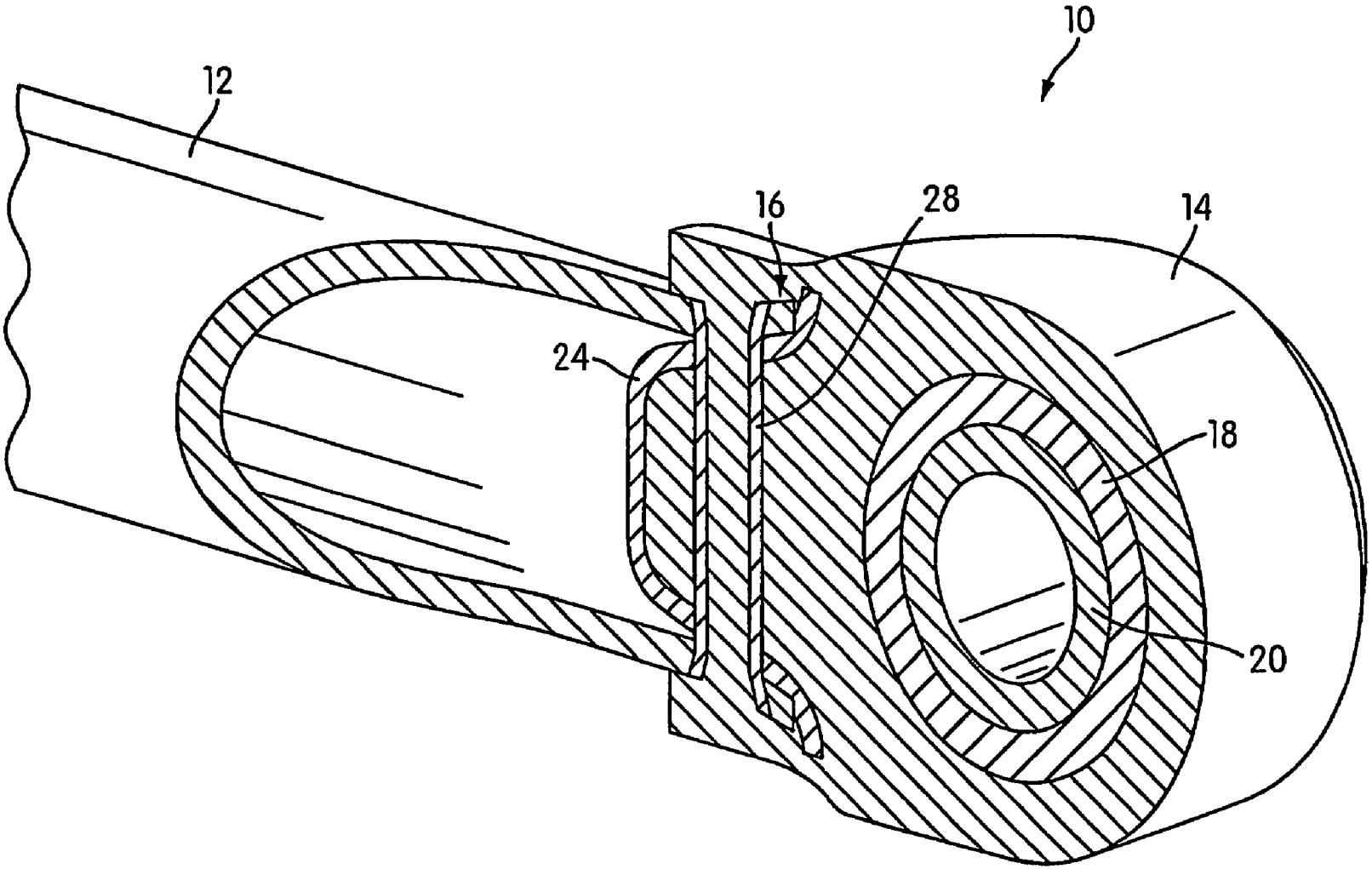
FIG. 6 is a partial cutaway view of the hybrid component of FIG. 5 in which a pin is inserted into holes in the tubular member and the cap member.
Figure 7:
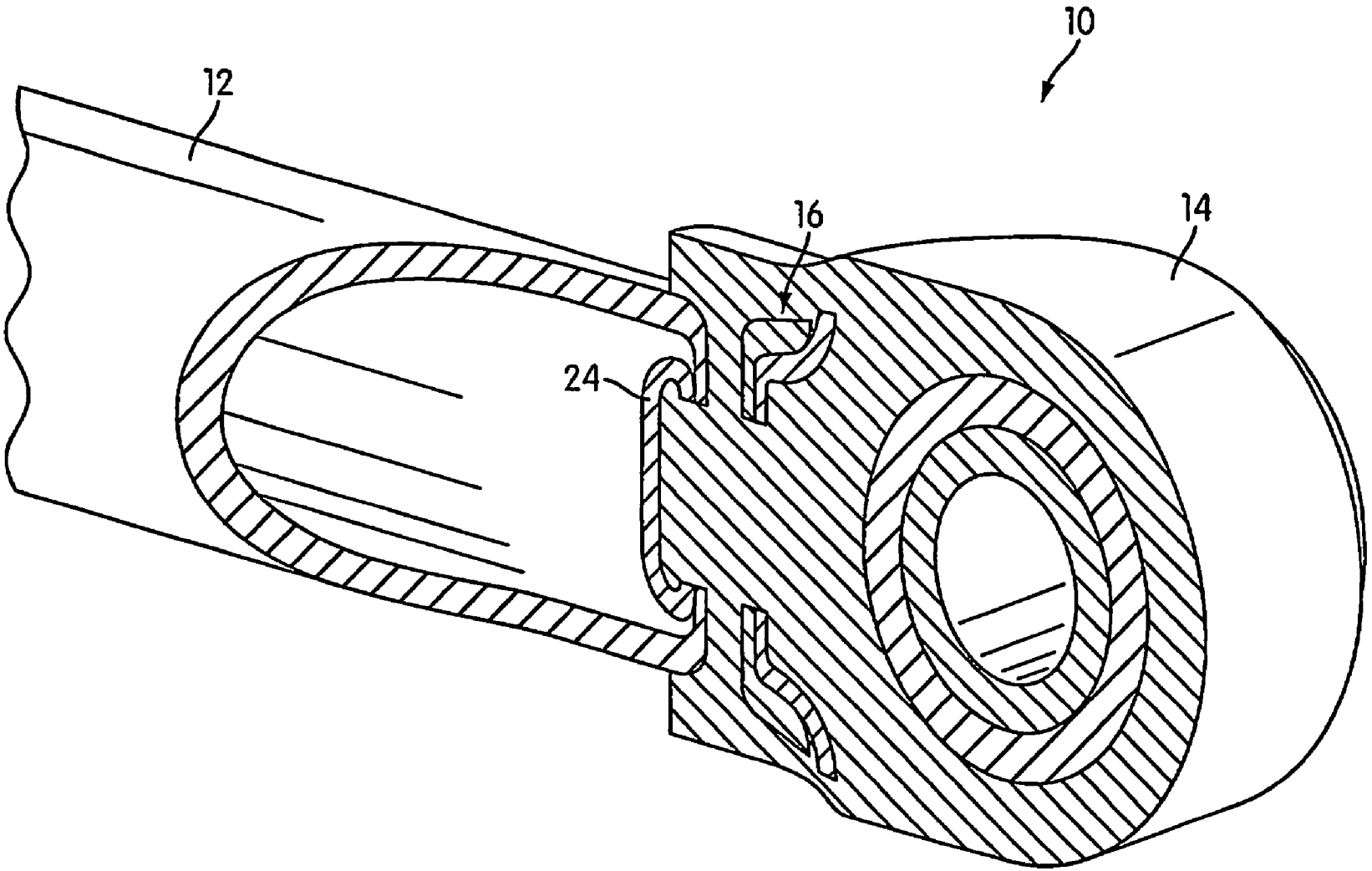
FIG. 7 is a partial cutaway view of the hybrid component of FIG. 5 in which the pin and holes in the tubular member and the cap member are omitted.

Referring now to FIGS. 5-7, another embodiment of the invention is shown in which the cast-in-place coupling member 14 is secured to the tubular member 12. As best shown in FIG. 5, the end portion 16 of the tubular member 12 is pierced to form a hole 22. In addition, the end portion 16 is slightly flared outwardly for receiving a cup-shaped cap member or plug 24 having a hole 26. The hole 22 of the tubular member 12 substantially aligns with the hole 22 in the plug 24 when the plug 24 is inserted into the end portion 16 of the tubular member 12. The plug 24 can be held in place by a friction force (interference fit), by a piercing or drilling operation, or mechanically via a hollow sleeve or pin. In the illustrated embodiment, at least a hollow pin is employed. Once the holes 22, 26 are aligned with each other, a pin 28 can be inserted through both holes 22, 26 to hold the plug 24 in place. As best shown in FIG. 6, the molten aluminum is allowed to flow into the plug 24 and the pin 28 to positively secure the coupling member 14 to the tubular member 12. It will be appreciated that the holes 22, 26 and the pin 28 are optional and may be omitted, as shown in FIG. 7. The plug 24 has a melting point greater than that of the molten cast metal and sufficient strength to avoid mechanical failure associated with the pressure casting process. Also, the plug may be extend into the end portion 16 as described above, or the plug may be structured such that it extends around the outside diameter of the end portion 16.

Referring now to FIGS. 9-13, another embodiment of the invention is shown in which the cast-in-place coupling member 14 is secured to the tubular member 12. In this embodiment, the open end portion 16 of the tubular member 12 is closed and sealed by a rotary swedging process, and then molten material is cast about the deformed end to form the coupling member 14. The rotary swedging process hammers the periphery of the tubular member 12 to deform and close the end of the tubular member 12 without the use of a cap member. Further, the rotary swedging process forms a non-uniform shape or undercut 32 in the tubular member 12. The non-uniform shape 32 provides a mechanical lock or joint between the coupling member 14 and the tubular member 12 to prevent the coupling member 14 from slipping off the tubular member 12. Also, the non-uniform shape 32 increase tensile strength of the joint.

Figure 10:
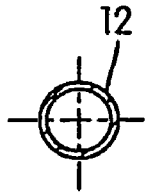
FIG. 10 is a cross-sectional view through line 10-10 of FIG. 9.
Figure 11:
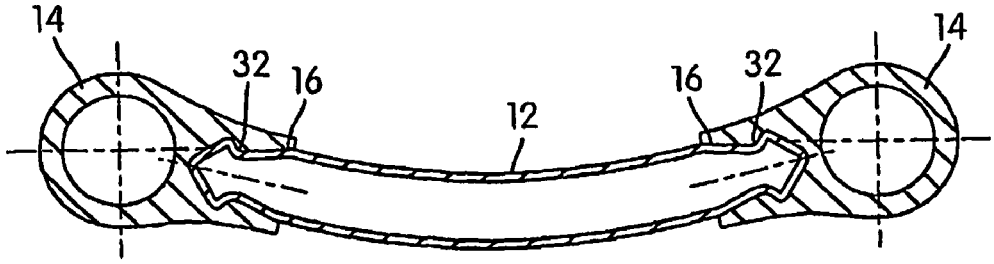
FIG. 11 is a cross-sectional view through line 11-11 of FIG. 9.
Figure 12:
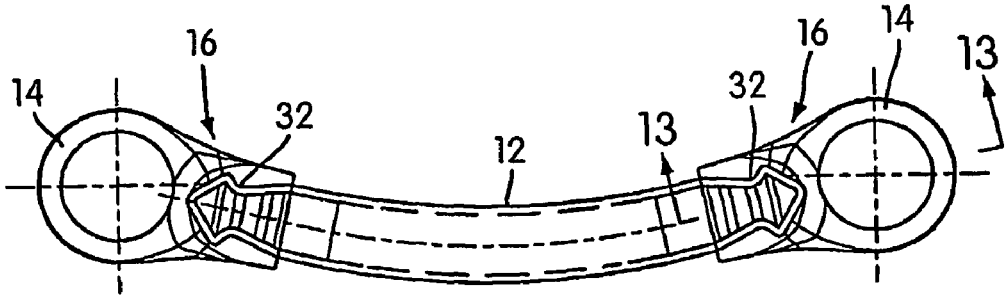
FIG. 12 is a top view of the hybrid component shown in FIG. 9.
Figure 13:
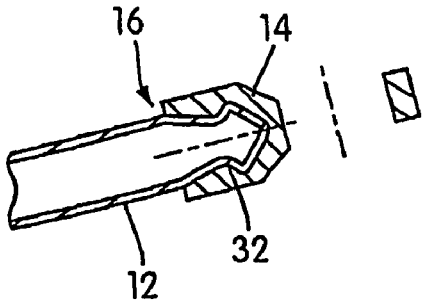
FIG. 13 is a cross-sectional view through line 13-13 of FIG. 12.
Figure 14:
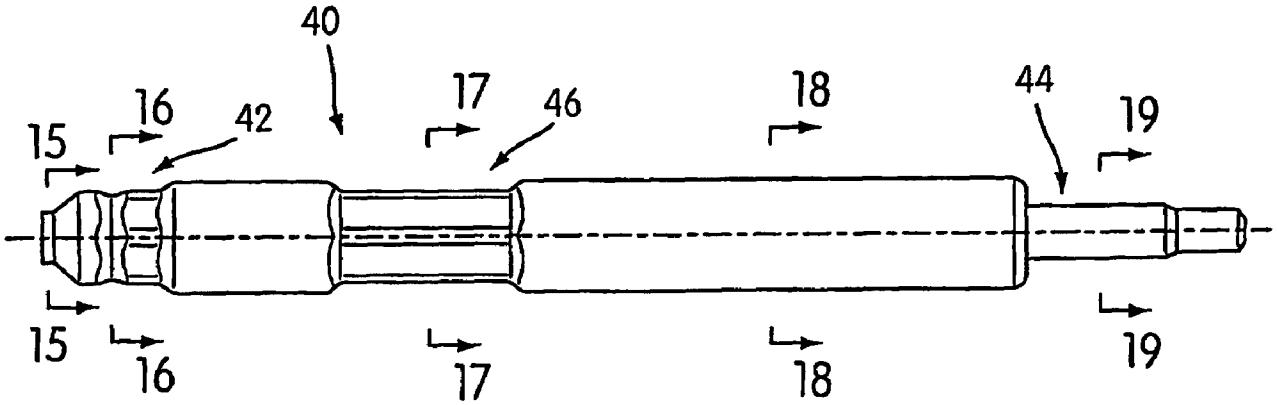
FIG. 14 is a side view of a hybrid component according to another embodiment of the invention.
Figure 19:
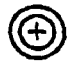
FIG. 19 is a cross-sectional view through line 19-19 of FIG. 14.
Figure 18:
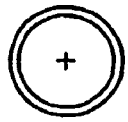
FIG. 18 is a cross-sectional view through line 18-18 of FIG. 14.
Figure 17:
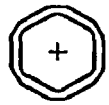
FIG. 17 is a cross-sectional view through line 17-17 of FIG. 14.
Figure 16:
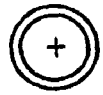
FIG. 16 is a cross-sectional view through line 16-16 of FIG. 14.
Figure 15:
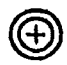
FIG. 15 is a cross-sectional view through line 15-15 of FIG. 14.
Figure 20:
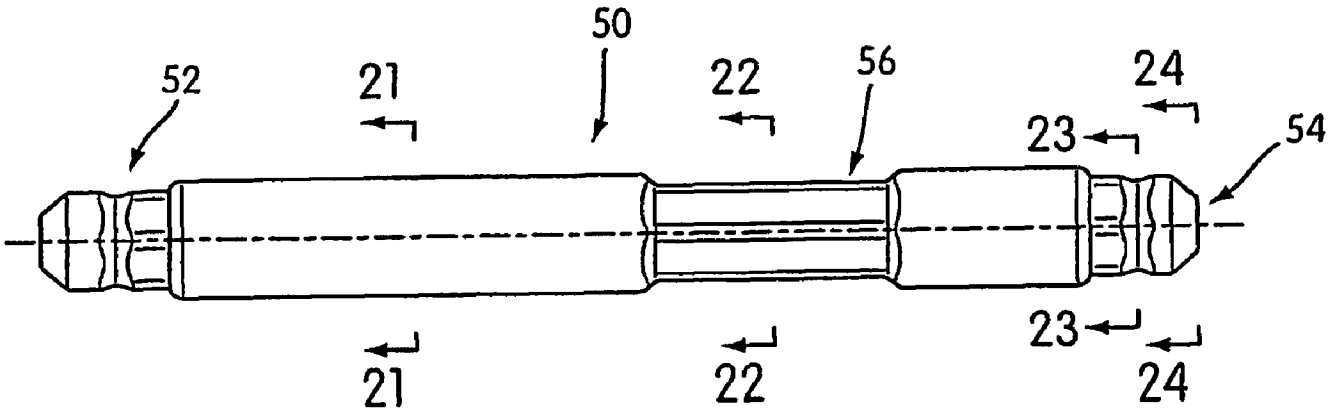
FIG. 20 is a side view of a hybrid component according to another embodiment of the invention.
Figure 24:
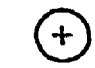
FIG. 24 is a cross-sectional view through line 24-24 of FIG. 20.
Figure 23:
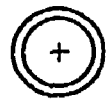
FIG. 23 is a cross-sectional view through line 23-23 of FIG. 20.
Figure 22:
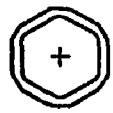
FIG. 22 is a cross-sectional view through line 22-22 of FIG. 20.
Figure 21:
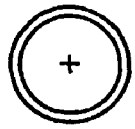
FIG. 21 is a cross-sectional view through line 21-21 of FIG. 20.

In the illustrated embodiment, the rotary swedging process also forms a non-circular shape, e.g., hexagon, octagon, etc, on the tubular member 12 including the end portions 16 as shown in FIG. 10. This provides a radial lock between the coupling member 14 and the tubular member 12 and increases the torsional strength of the joint.

Also, the rotary swedging process may be used around a loose piece plug to secure the plug to the open end of the tubular member. This results in closure of the open end portion of the tubular member at a low cost and weight. Further, this arrangement provides an opportunity to close large diameter tubular sections.

In addition, to increase the strength of the joint between the deformed or capped tubular member and the coupling member, single or multiple openings may be created in the tubular member using conventional drill, pierce or cutting processes which are filled with cast material during the cast-in place technique.

In addition, to increase the strength of the joint between the deformed or capped tubular member and the coupling member, a nickel-based alloy may be applied to the surface of the tubular member using conventional coating processes such as laser deposition (DMD), Plasma Transfered Arc (PTA), oxygen-fuel thermal spray processes. In some cases, the coated tubular member may be heat treated after the nickel-alloy coating is applied to the end of the tubular member. The nickel-based coating also increases the corrosion resistance.

Also, it should be understood that a coupling member may be cast onto the end portion of a tubular member as discussed above or a coupling member may be cast anywhere along the length or major axis of a tubular member, e.g., in the middle of the tubular member. Thus, the casting is not limited to the ends of the tubular member.

For example, FIGS. 14-19 illustrate an embodiment of a tubular member 40 wherein the end portions 42, 44 are closed by a rotary swedging process. Moreover, an intermediate portion 46 is formed with a non-circular shape, e.g., hexagon, by the rotary swedging process (see FIG. 17). Thus, the tubular member 40 includes a non-circular shape in multiple areas, not just the end portions. As illustrated, the non-circular shapes are formed in localized areas and include reduced cross-sectional areas. This arrangement provides flexibility to add joints in areas other than the end portions. That is, a coupling member may be cast over the non-circular intermediate portion 46 of the member. Also, the non-circular shape provides a mechanical lock to increase tensile and compressive strength of the joint, and the non-circular shape increases the torsional strength of the joint.

FIGS. 20-24 illustrate another embodiment of a tubular member 50 having end portions 52, 54 and an intermediate portion 56 deformed by a swedging process. As illustrated, the end portions 52, 54 are closed by the swedging process, and the intermediate portion 56 is deformed by the swedging process to include a non-circular shape, e.g., hexagonal (see FIG. 22).

In another embodiment, the hybrid component may include a hollow tubular member having two or more components formed by a conventional process, e.g., stamping, roll forming, etc. The two or more components may be joined using conventional welding processes. The tubular member may also include an extended section, e.g., flange, on one or both ends of the tubular member to close the end(s) of the tubular member. The extended section may be welded to close the end(s) of the tubular member. The size of the extended section used to close the end(s) of the tubular member may be larger than the closure area in one or both dimensions to create an undercut feature, increasing the "pull-off" strength of the hybrid cast component. Optionally, the joint area of the tubular member may include depressions formed during the stamping/forming process to provide an undercut feature to increase the tensile strength ("pull-off" force) of the hybrid component.

Also, the tubular member may include hollow tubular/hydroformed shapes as discussed above, or may include solid geometric shapes. For example, coupling members may be cast on the end portions and/or intermediate portions of a solid geometric shaped member. An example is an I-beam shape with cast nodes on the end(s) or along the major axis of the I-beam shape.

Figure 8:
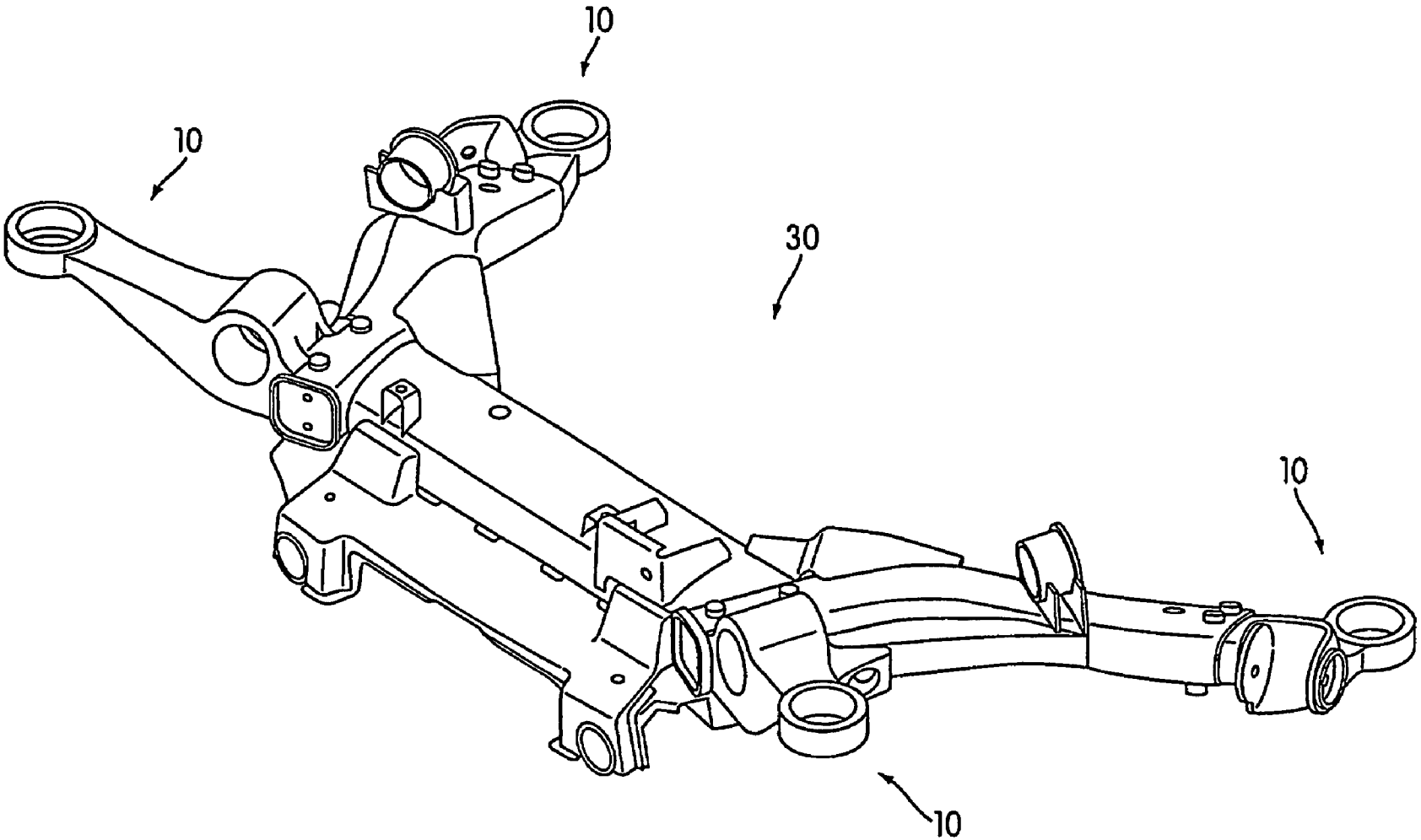
FIG. 8 is a perspective view of an engine mount incorporating hybrid components according the principles of the invention.
Figure 9:
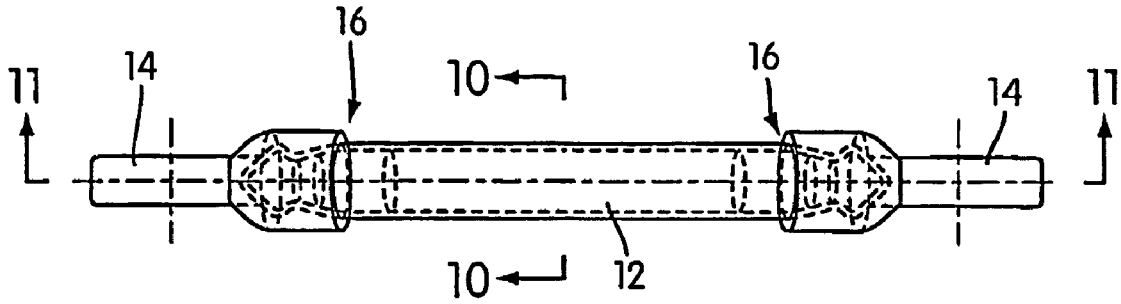
FIG. 9 is a side view of a hybrid component according to another embodiment of the invention.

The hybrid component 10 of the present invention is not limited to a suspension arm, as shown in the above-mentioned embodiments of the invention. For example, the hybrid component 10 of the present invention may also be used as an engine mount 30, as shown in FIG. 8. Further, the hybrid component may be used in chassis, body, and power train automotive components.

Figure 25:
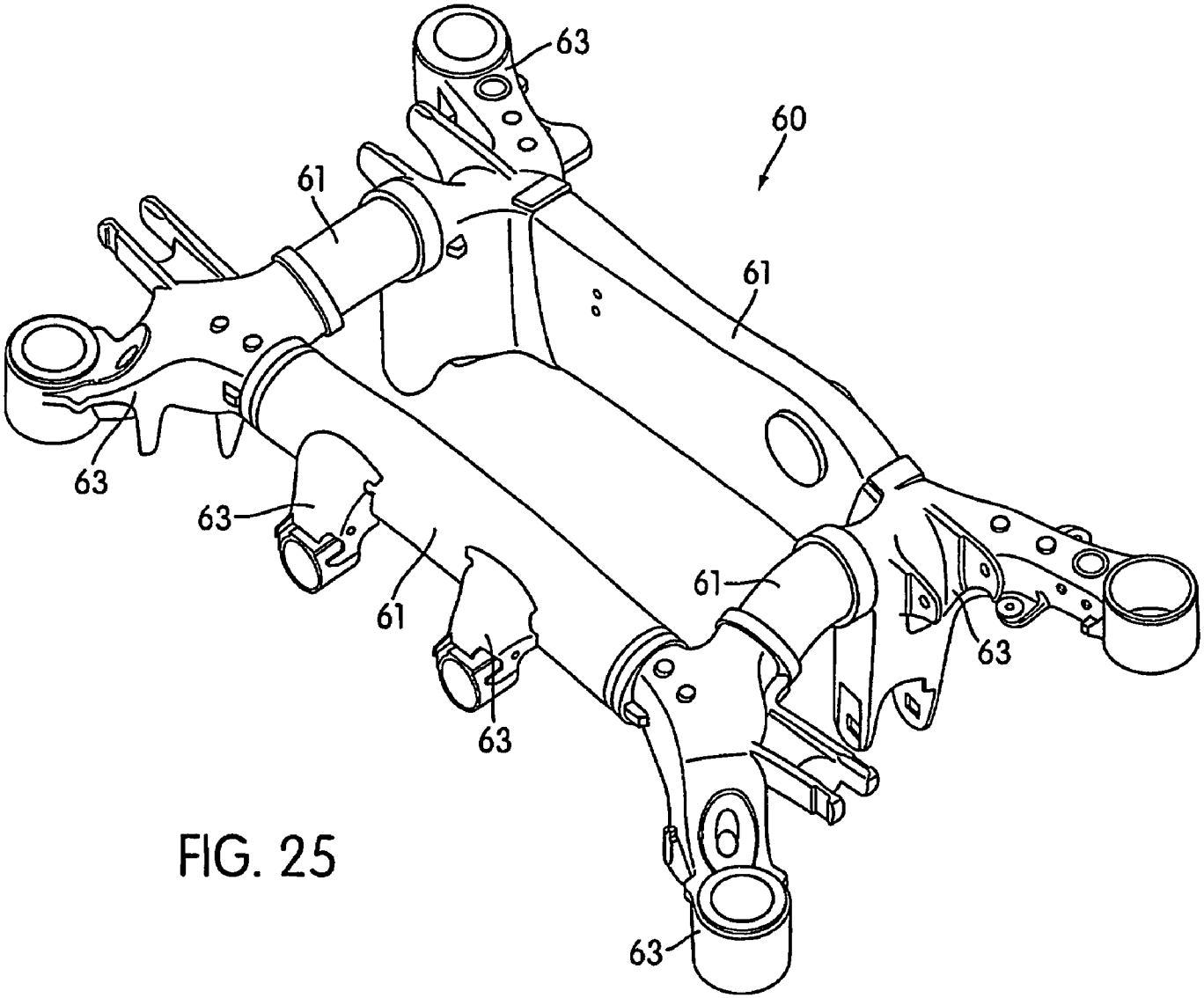
FIG. 25 is a perspective view of an automotive rear cradle incorporating hybrid components according an embodiment of the invention.
Figure 26:
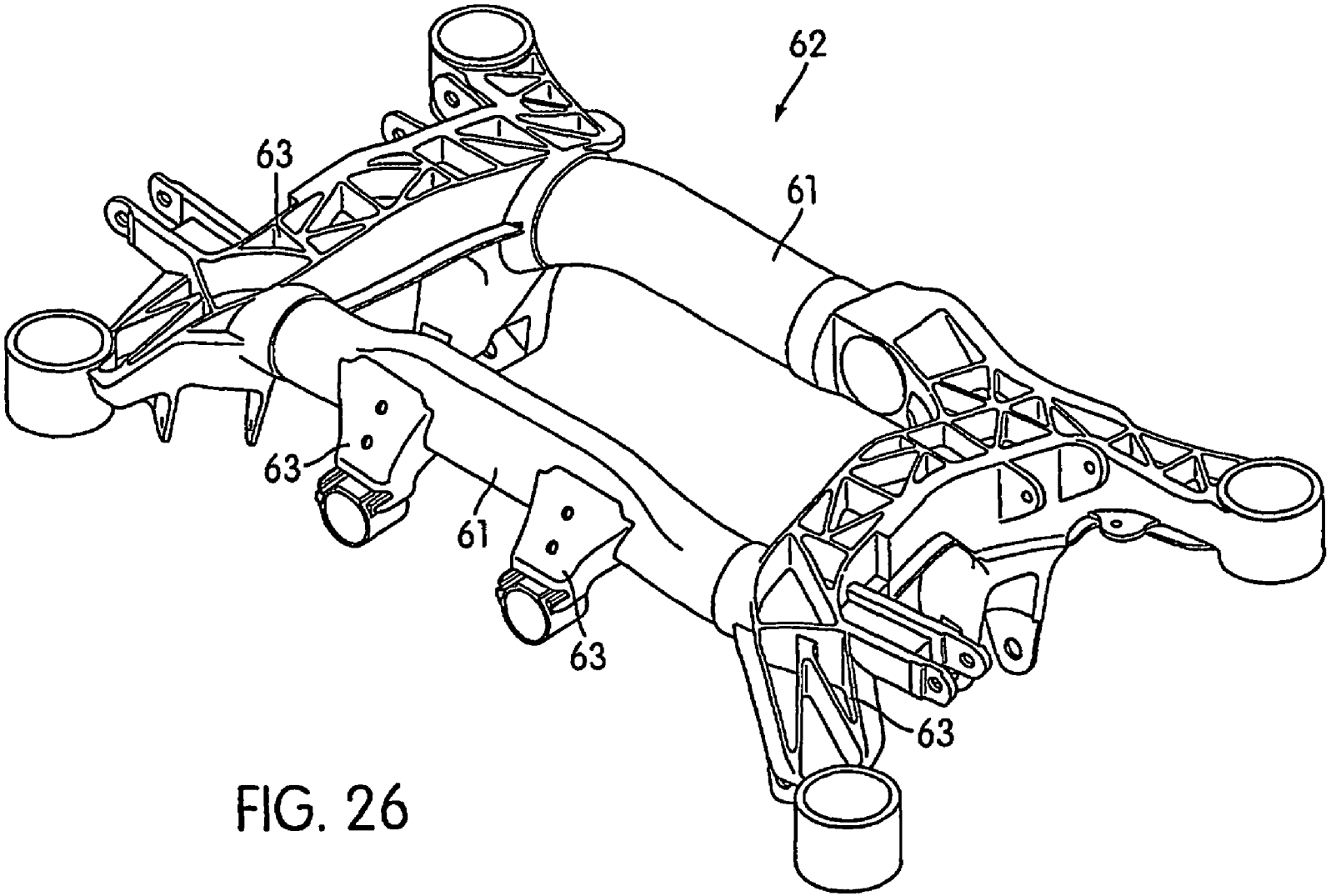
FIG. 26 is a perspective view of an automotive rear cradle incorporating hybrid components according an embodiment of the invention.

Also, FIGS. 25 and 26 illustrate embodiments of an automotive rear cradle 60, 62, respectively, incorporating hybrid components. As illustrated, the rear cradles 60, 62 are each formed with tubular members 61 and coupling members 63 cast onto the tubular members 61. The rear cradles 60, 62 incorporate hybrid components to provide a structure that results in reduced cost and weight, while maintaining high strength. For example, a cradle having a shape similar to cradles 60, 62 comprised of 100% steel has a mass of about 22 kg and a cost of about $80. A cradle having a shape similar to cradles 60, 62 comprised of 100% aluminum has a mass of about 15.2 kg and a cost of about $125. The cradles 60, 62 are comprised of about 47% aluminum and 53% steel, and have a mass of about 15.6 kg and a cost of about $100.

Figure 27:
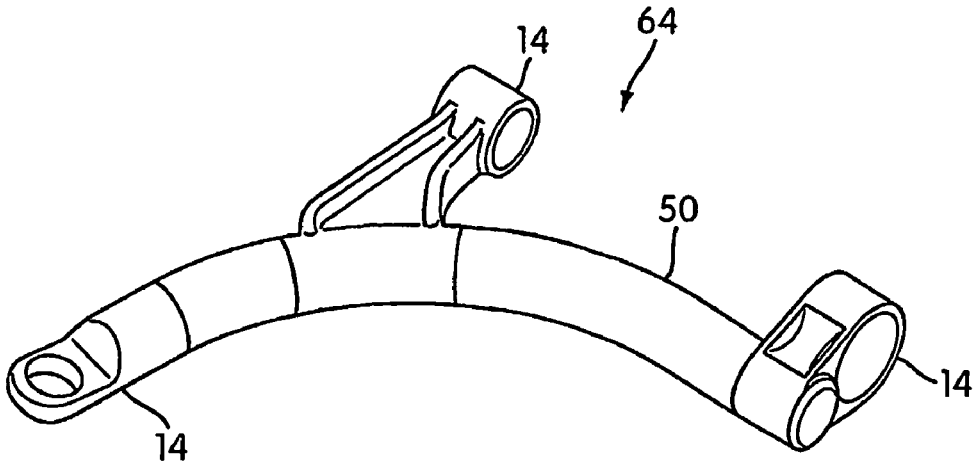
FIG. 27 is a perspective view of a hybrid control arm constructed according to an embodiment of the invention.
Figure 28:
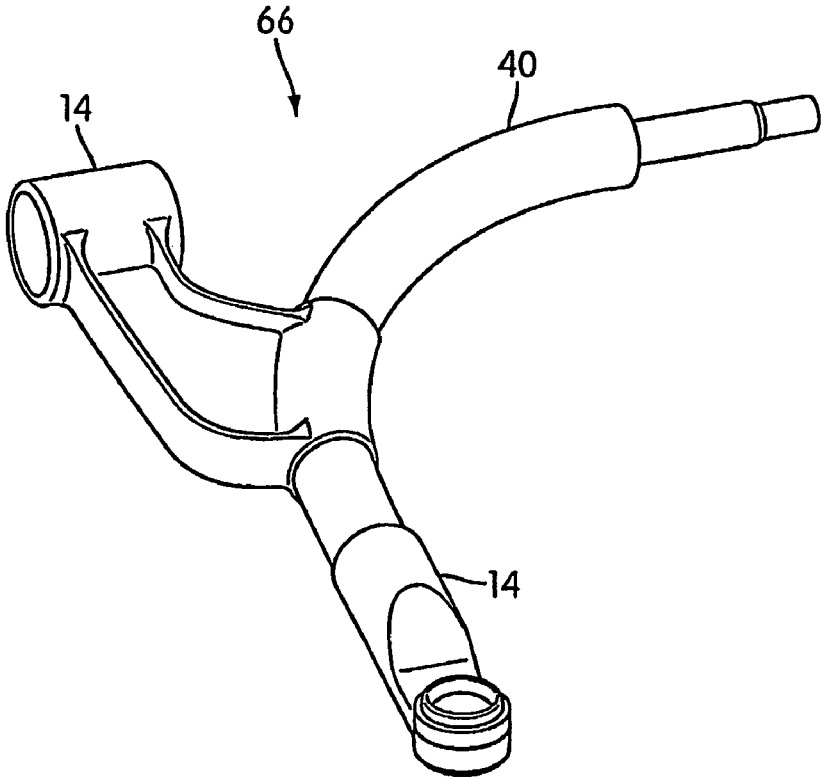
FIG. 28 is a perspective view of a hybrid control arm constructed according to an embodiment of the invention.
Figure 29:
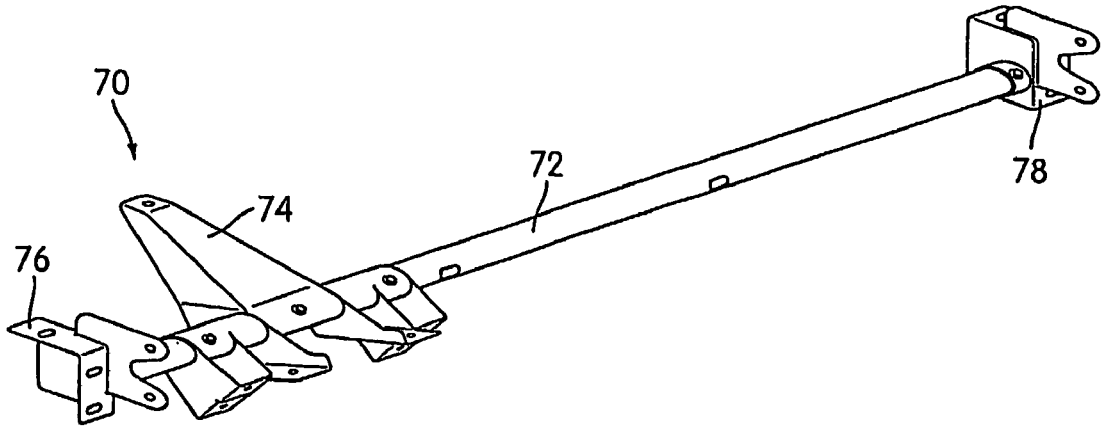
FIG. 29 is a perspective view of an instrument panel support system constructed according to an embodiment of the invention.

Additionally, FIGS. 27 and 28 illustrate embodiments of hybrid control arms 64, 66, respectively. As illustrated, the control arm 64 includes a tubular member similar to tubular member 50 discussed above (the tubular member 50 may have a curved configuration as illustrated in FIG. 27), and coupling members 14 cast onto the tubular member 50 at end portions and an intermediate portion thereof. As illustrated, the control arm 66 includes a tubular member similar to tubular member 40 discussed above (the tubular member 40 may have a curved configuration as illustrated in FIG. 28), and coupling members 14 cast onto the tubular member 50 at an end portion and an intermediate portion thereof.

The control arm 64 incorporates hybrid components to provide a structure that results in reduced cost and weight, while maintaining high strength. For example, a control arm having a shape similar to control arm 64 comprised of 100% iron has a mass of about 6.2 kg and a cost of about $11. A control arm having a shape similar to control arm 64 comprised of 100% aluminum has a mass of about 2.4 kg and a cost of about $13.50. The control arm 64 is comprised of about 35% aluminum and 65% steel, and has a mass of about 2.7 kg and a cost of about $11.80.

Similarly, the control arm 66 incorporates hybrid components to provide a structure that results in reduced cost and weight, while maintaining high strength. For example, a control arm having a shape similar to control arm 66 comprised of 100% steel has a mass of about 4.13 kg. A control arm having a shape similar to control arm 66 comprised of 45% aluminum and 55% steel and formed by aluminum casting and steel attachments has a mass of about 2.4 kg and a cost of about $12.50. The control arm 66 is comprised of about 33% aluminum and 67% steel, and has a mass of about 2.13 kg and a cost of about $11.50.

FIGS. 29-33 illustrate an instrument panel support system 70 that incorporates hybrid components. Specifically, the instrument panel support system 70 includes a tubular cross-beam 72, a main steering column/instrument cluster bracket 74, and left-hand and right-hand mounting brackets 76, 78. The mounting brackets 76, 78 are structured to mount the support system 70 within a vehicle, and the main steering column/instrument cluster bracket 74 is structured to mount a number of vehicle components, e.g., steering column, instrument panel, console mount, glove box mount, etc. The instrument panel support system 70 is structured such that the brackets 74, 76, 78 are molded, e.g., from aluminum alloy, directly onto the cross-beam 72.

Figure 30:
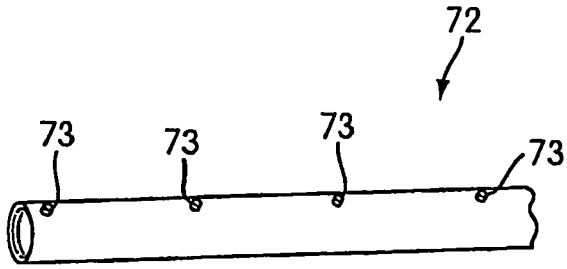
FIG. 30 is a perspective view of tubular cross-beam of the support system shown in FIG. 29.

As shown in FIG. 30, the cross-beam 72 is formed from a single diameter tube, e.g., steel tube, and anti-rotation devices, e.g., protrusions 73, for "as cast" brackets are incorporated onto the cross-beam 72. Also, the cross-beam 72 may include cap devices to prevent cast material, e.g., aluminum alloy, from entering the cross-beam 72.

Figure 31:
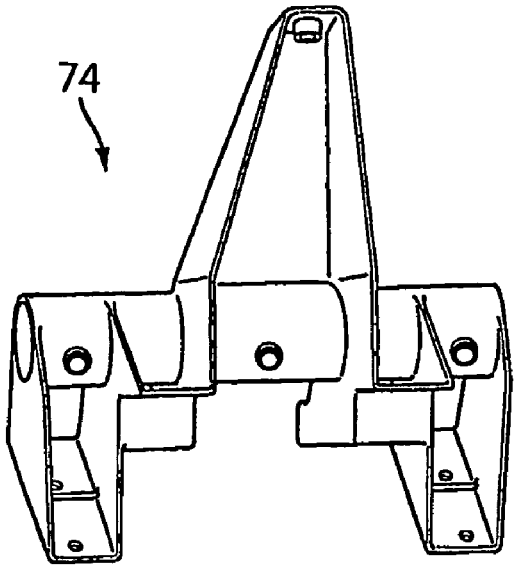
FIG. 31 is a perspective view of a main steering column/instrument cluster bracket of the support system shown in FIG. 29.
Figure 32:
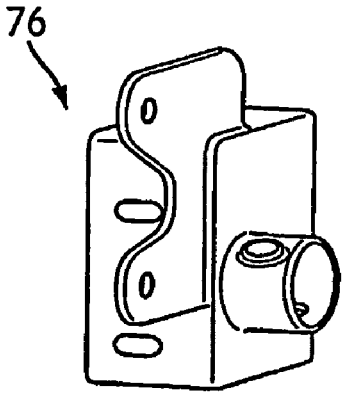
FIG. 32 is a left-hand mounting bracket of the support system shown in FIG. 29.
Figure 33:
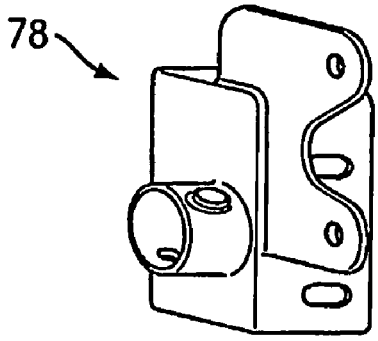
FIG. 33 is a right-hand mounting bracket of the support system shown in FIG. 29.

As shown in FIGS. 31-33, each bracket 74, 76, 78 forms a one-piece structure with multiple component attachment elements. By combining attachment elements into a single structure, the number of parts can be reduced. Each bracket 74, 76, 78 is molded from a lightweight material, e.g., aluminum alloy, directly onto the cross-beam 72. This arrangement allows each of the brackets 74, 76, 78 to have a lower mass than the combination of steel component attachment brackets, e.g., due to the lighter mass properties of aluminum. The wall thickness of the brackets 74, 76, 78 may be cast thicker than steel thereby providing a more rigid bracket. Also, with the brackets 74, 76, 78 being cast onto the cross-beam 72, welding operations can be reduced which reduces manufacturing complexity. This will reduce part distortion. Additionally, all the brackets 74, 76, 78 can be molded onto the cross-beam 72 in a common operation allowing for consistent bracket to bracket dimensional integrity. The NVH qualities of the brackets 74, 76, 78 are also improved.

The present invention is not limited to the above-mentioned embodiments of the invention. For example, the main body 12 and the coupling member 14 may be made of an extruded article, casting, iron materials or other metallic materials, or synthetic resin. Further, the present invention is not limited by the use of the hybrid component 10 with a vehicle.

The hybrid component 10 of the invention allows the manufacturer to use less expensive materials for the tubular member 12, such as steel, or the like, while using a relatively more expensive material, such as aluminum, or the like, for the coupling member 14, thereby reducing the cost of the hybrid component 10 as compared to conventional components made entirely of aluminum. However, the entire hybrid component 10 can be made of aluminum, or the like, if desirable.

It will be appreciated that the embodiments of the invention are only illustrative in nature, and that the principles of the invention can be practiced in many different ways. For example, the principles of the invention can be practiced with any type of attachment configuration beside a J-hook or Y-hook configuration shown in the illustrative embodiments, such as an X-hook, T-hook, or the like, to positively secure the coupling member to the tubular member.

In addition to the methods disclosed above, other methods can be used, together with the methods mentioned above to avoid the presence of a crevice between the tubular member 12 and the coupling member 14. For example, the tube surface can be coated prior to or after the casting operation in the "joint area" to avoid any crevices that would cause galvanic corrosion. Another example is to apply pressure to the outside surface of the tubular member when the casting die closes and during the metal casting process, effectively reducing the physical dimension of the tubular member within the elastic range. When the casting die opens the compressive force on the tubular member is removed and the tube expands within the constraint of the casting, thus minimizing the "gap" between the tubular member and the casting, avoiding any crevice that could result in galvanic corrosion. A further example is to metallurgically bond the tubular member and cast metal to avoid any crevices that would cause galvanic corrosion. The bonding agent may be applied using thermal spray processing. Examples of metallurgically compatible materials which can be sprayed include zinc-based, copper-based, and nickel-based alloys.

The embodiments of the subject application illustrated herein employ the concept of fabricating hybrid "Hydrocast" modules comprising one or more high strength tube(s) or hydroformed components with cast connection or attachment points can yield significant weight and cost benefits. Weight savings can be realized by utilizing the high strength-to-weight ratio inherent of tubular construction and the light weight, machinability, near net shape, and ductility of cast metal alloys. The use of high strength cast alloys and processes which do not require heat treatment or which require only age hardening provide cost saving potential through energy avoidance.

The casting methods of the embodiments of the invention may employ a semi-solid casting process to fabricate structural components, e.g., automotive structural components, comprised of a preformed high strength steel insert and cast aluminum. The method involves placing a preformed and heat treated steel tube into a conventional steel die cast die, casting semi-solid aluminum around specific sections of the preformed steel tube, and creating a component comprised of dissimilar materials (steel and aluminum). The hybrid material (aluminum/steel) structural component may be subsequently heat treated (artificially aged at an elevated temperature of approximately 400 degrees F.) to a T5 heat treatment specification to improve the mechanical properties of the cast aluminum. Subsequent to the heat treatment process, the component may be machined and assembled using conventional processing and methods.

Cast aluminum materials commonly used for semi-solid casting include those which have a yield strength typically greater than 150 MPa. Typical cast aluminum materials for automotive structural applications include aluminum, silicon and magnesium elements (AlSiMg 356 alloy) and aluminum, silicon, copper and magnesium elements (AlSiCuMg 357 alloy). The desired mechanical properties are achieved by solution heat treatment and artificial aging referred to as T6 or T7 heat treatment. The solution heat treatment process includes heating the aluminum to approximately 1,000 degrees F. (538 C) followed by a water quench and an artificial age at a temperature of 440 degrees F. (220 C). Aluminum castings manufactured using the semi-solid casting process do not require a solution heat treatment cycle to achieve an acceptable yield strength, typically greater than 180 MPa. Semi-solid castings have yield strength greater than 180 MPa with only an artificial aging (T5) heat treatment cycle, which involves exposing the aluminum casting to a temperature of 440 degrees F. (220 C).

The preformed steel component of the hybrid material casting may be an ultra high strength steel (UHSS), boron steel or stainless steel having a minimum yield strength of 1,300 MPa. The yield strength associated with the steel component is achieved by heat treatment quench and temper. Exposure of the steel component to elevated temperatures of 1,000 degrees F., typical to that of aluminum solution heat treatment temperatures, results in a significant reduction in yield strength, below the 1,300 MPa design guideline.

| Grade | Description | Yield Strength 400° F. | Yield Strength 1,000° F. |
|---|---|---|---|
| 15B21 | Boron Steel | 840 MPa | 1,340 MPa |
| 4130 | UHHS | 1860 MPa | 1,160 MPa |
| 4340 | UHHS | 1670 MPa | 1,050 MPa |
| 420 | Stainless Steel | 1300 MPa | 1,000 MPa |

The ability to fabricate a cast aluminum/steel hybrid component having a yield strength of a cast aluminum greater than about 180 MPa and a steel yield strength greater than about 1,300 MPa can be accomplished if the cast aluminum/steel hybrid component is not exposed to the aluminum solution heat treatment temperature (typically 1000 F). The semi-solid aluminum casting process enables the ability to obtain a minimum yield strength of 180 MPa by subjecting the hybrid component to a T5 artificial age heat treatment (typically 440° F.), this avoiding degradation of the steel material properties which results from "overtempering" during the aluminum solution heat treatment processing.

Traditional aluminum casting methods require a T6 solution heat treatment (1,000° F.), quench and artificial age (400° F.) to realize a yield strength greater than that of 180 MPa. Exposure of high strength steel to a temperature of 1,000° F. reduces the yield strength to a level below 1,300 MPa. Therefore, it is not possible using conventional casting methods to fabricate an aluminum/steel hybrid structure comprised of a cast aluminum alloy having a minimum yield strength of 180 MPa and a steel component having a yield strength greater than 1,300 MPa. It is possible to fabricate a cast aluminum/steel hybrid component using the semi-solid casting process by subjecting the steel to only a T5 artificial age heat treatment.

If a cast aluminum/steel hybrid component is manufactured using traditional casting processes and the steel is subjected to the solution heat treatment temperature of 1,000 F, the section size of the steel component should be increased proportionally to compensate for the reduction in yield strength imposed by the heat treatment process. This increase in section size may result in additional cost and weight of the steel component, which offsets the advantage of making a cast aluminum hybrid component.

If a cast aluminum/steel hybrid component is manufactured using traditional casting processes and the cast aluminum is subjected to only an artificial age heat treatment temperature of 440 F, the section size of the aluminum component should be increased proportionally to compensate for the yield strength obtained by the T5 heat treatment process. This increase in section size results in additional cost and weight of the aluminum component, which offsets the advantage of making a cast aluminum hybrid component.

Figure 34:
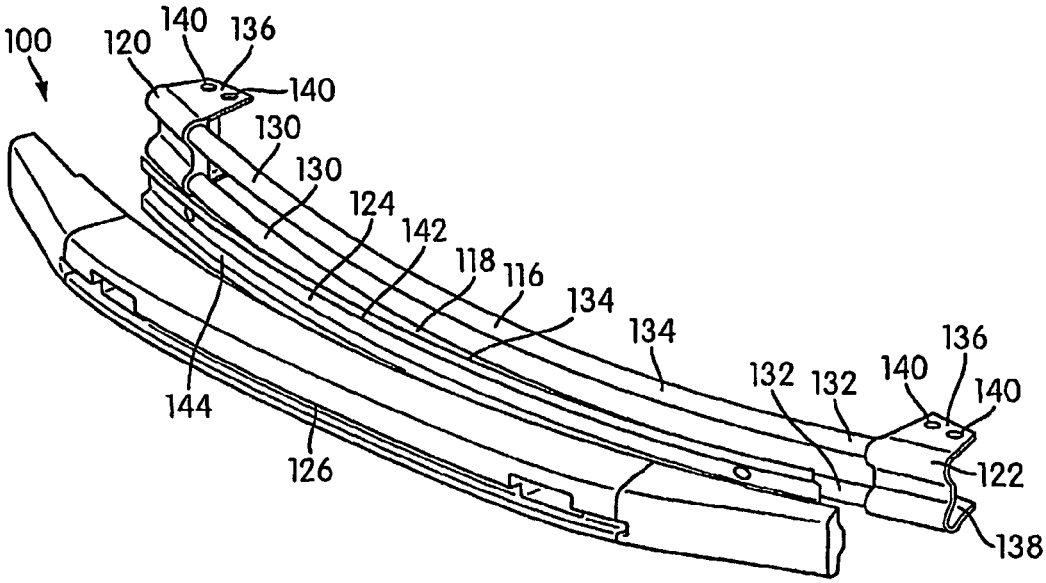
FIG. 34 is an exploded view illustrating a bumper assembly constructed in accordance with an embodiment of the invention.
Figure 35:
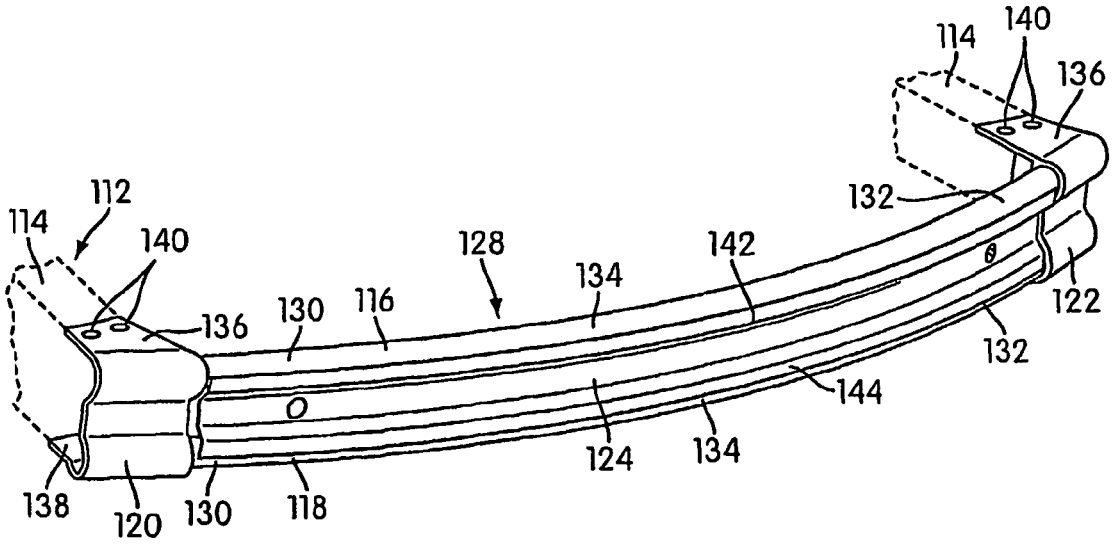
FIG. 35 is a front perspective view illustrating a middle member of the bumper assembly shown in FIG. 34 attached to tubular members of the bumper assembly shown in FIG. 34.
Figure 36:
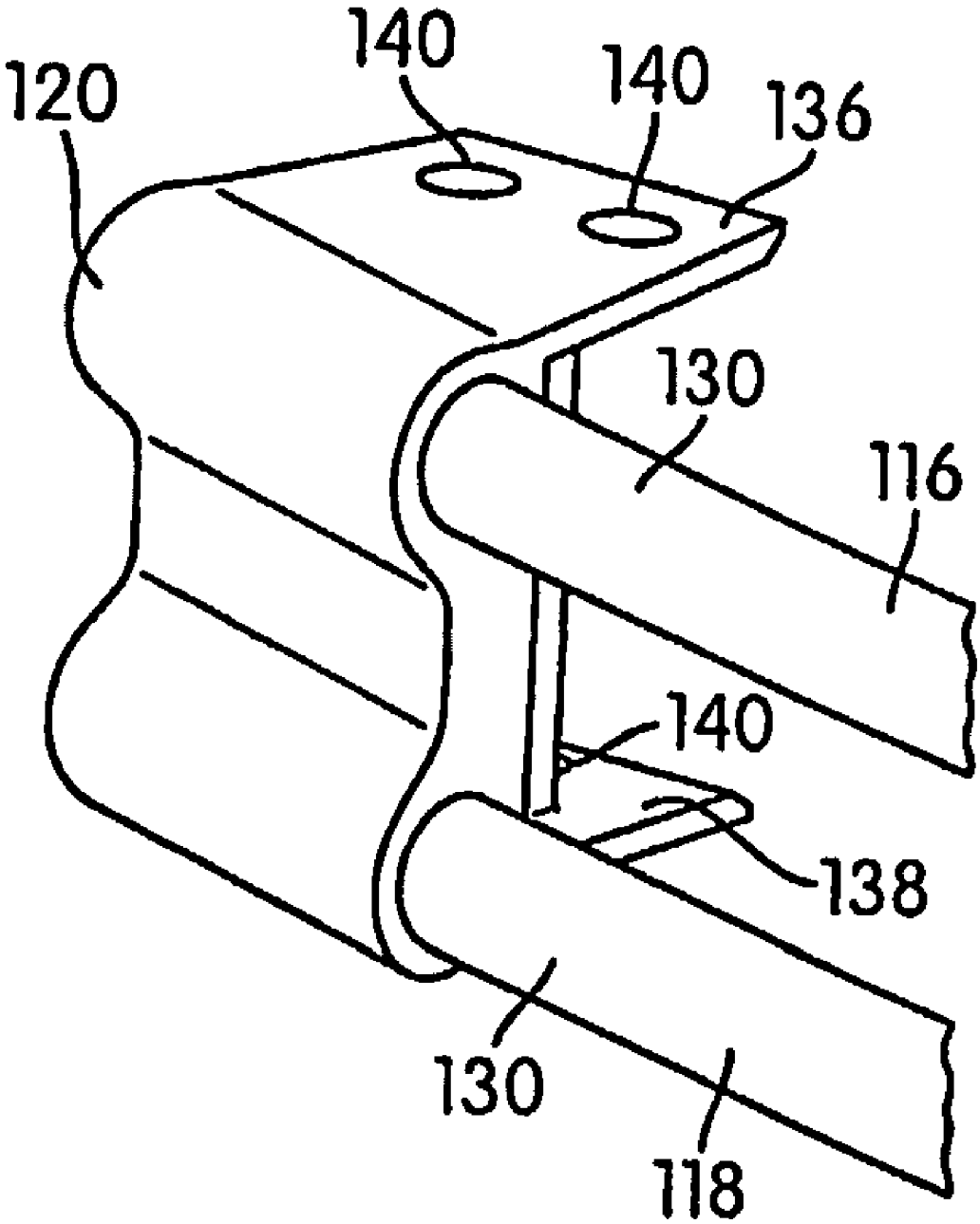
FIG. 36 is an enlarged front perspective view illustrating a mounting member of the bumper assembly shown in FIG. 34 attached to tubular members of the bumper assembly shown in FIG. 34.

FIGS. 34-44 illustrate additional embodiments of the invention that can employ semi-solid casting as discussed herein. FIGS. 34-36 illustrate a bumper assembly 100 for a vehicle 112 constructed according to an embodiment of the present invention. As illustrated herein, the bumper assembly 100 illustrates one example of a bumper assembly that uses a combination of heavier materials, such as steel, along with lighter materials to decrease the overall weight of the bumper assembly. The bumper assembly 100 is structured to be mounted to a space frame 114 of the vehicle 112 at either the front end or the rear end of the vehicle 112. The bumper assembly 100 may be utilized on any suitable vehicle. An example of a prior art vehicle space frame is disclosed in U.S. Pat. No. 6,092,865 to Jaekel et al., which is incorporated herein by reference thereto.

The main components of the bumper assembly 100 are longitudinally extending tubular members 116, 118, first and second mounting members 120, 122 attached to the tubular members 116, 118, a middle member 124 attached to and extending between the tubular members 116, 118, and an impact-absorption device 126 attached to the tubular members 116, 118. The tubular members 116, 118 and the middle member 124 may together constitute a bumper member 128 constructed to protect the vehicle 112 from impact.

In the illustrated embodiment, the first and second mounting members 120, 122 are rigidly mounted to the tubular members 116, 118 in spaced-apart relation such that the tubular members 116, 118 extend between the first and second mounting members 120, 122. Further, the first and second mounting members 120, 122 are positioned between the tubular members 116, 118 and the space frame 114 of the vehicle 112. The impact absorption device 126 is rigidly mounted on the other side of the tubular members 116, 118 and extends along the length of the bumper assembly 100. The bumper assembly 100 is mounted to the space frame 114 of the vehicle 112 by rigidly mounting each mounting member 120, 122 to the space frame 114. In use, the impact absorption device 126 is positioned to receive collision forces during a front end or rear end collision. The impact absorption device 126 collapses during the collision in order to dissipate energy and thus reduce the magnitude of collision forces being transmitted to the bumper member 128 (tubular members 116, 118 and middle member 124) and the space frame 114. Examples of prior art bumper assemblies are disclosed in U.S. Pat. No. 6,663,150 to Evans and U.S. Pat. No. 6,672,635 to Weissenborn et al., the entireties of both being incorporated herein by reference.

In the illustrated embodiment, the bumper assembly 100 is structured such that the mounting members 120, 122 are constructed of aluminum rather than steel. By using lighter mounting members 120, 122, the weight of the bumper assembly 100 is significantly reduced with respect to conventional bumper assemblies. In embodiments, the bumper assembly's weight is about 45% less than conventional bumper assemblies. Additionally, aluminum mounting members 120, 122 also reduce manufacturing costs.

Further to modify the bumper assembly 100 for different vehicles, the manufacturer can simply modify the mounting members 120, 122 to correspond to the specific bumper mounting arrangement of a vehicle. This allows the tubular members 116, 118, the middle member 124, and the impact-absorption device 126 to remain as common parts. Thus, the interchangeability of mounting members 120, 122 for different vehicles simplifies the manufacturing process and reduces manufacturing costs.

As illustrated, the tubular members 116, 118 include two substantially parallel tubular members. Each of the tubular members 116, 118 has a generally circular cross-sectional configuration. Also, each of the tubular members 116, 118 is formed from steel and may have a hollow or solid construction. However, each of the tubular members 116, 118 may have any other suitable configuration. Also, any number of tubular members can be employed, as desired.

The tubular members 116, 118 are bent to provide each tubular member 116, 118 with opposing end portions 130, 132 and a centrally disposed intermediate portion 134 extending between the end portions 130, 132. The tubular members 116, 118 are bent to impart a longitudinal curvature to the bumper assembly 100. The tubular members 116, 118 may be bent into the desired shape in any suitable manner, e.g., roll forming, hydroforming. Further details of the hydroforming process are provided in U.S. Pat. No. 6,092,865 to Jaekel, which is incorporated herein by reference thereto. Also, the tubular members 116, 118 may vary in length and longitudinal curvature to suit various vehicle widths and contours.

The mounting members 120, 122 are constructed of aluminum and each of the mounting members 120, 122 filly encapsulates an end of each of the two tubular members 116, 118. Specifically, the mounting member 120 fully encapsulates the end portions 130 of the tubular members 116, 118, and the mounting member 122 fully encapsulates the opposing end portions 132 of the tubular members 116, 118. In the illustrated embodiment, the mounting members 120, 122 encapsulate the tubular members 116, 118 by being cast onto the tubular members 116, 118. That is, when manufacturing the bumper assembly 100, the steel tubular members 116, 118 are first formed, and then the aluminum mounting member 120 is cast onto the end portions 130 of the tubular members 116, 118 and the aluminum mounting member 122 is cast onto the opposing end portions 132 of the tubular members 116, 118. However, the mounting members 120, 122 may be attached to the tubular members 116, 118 in any other suitable manner, e.g., welding.

As shown in FIG. 36, each mounting member 120, 122 is in the form of a bracket that provides upper and lower mounting plates 136, 138 configured to mount the tubular members 116, 118 to the vehicle space frame 114. In the illustrated embodiment, each of the mounting plates 136, 138 includes one or more openings 140 for mounting each mounting member 120, 122 to the space frame 114, e.g., by fasteners. However, the mounting members 120, 122 may be secured to the space frame 114 in any other suitable manner, e.g., welding. Moreover, the mounting members 120, 122 may have any other suitable structure to facilitate connection to the vehicle 112.

The middle member 124 may be constructed of any suitable material, e.g., steel, plastic composite, etc., and extends substantially along the entire length of the tubular members 116, 118. The middle member 124 is bent to provide the middle member 124 with upper and lower mounting portions 142, 144. The middle member 124 is also bent to impart a longitudinal curvature to the middle member 124 that corresponds to the longitudinal curvature of the tubular members 116, 118. The middle member 124 is attached to the tubular members 116, 118 such that the upper mounting portion 142 engages the tubular member 116 and the lower mounting portion 144 engages the tubular member 118. The middle member 124 may be secured to the tubular members 116, 118 by welding, or in any other suitable manner. The middle member 124 adds rigidity and reinforces the tubular members 116, 118. Further, the middle member 124 distributes load being transmitted to the tubular members 116, 118.

In the illustrated embodiment, the impact-absorption device 126 is constructed from a non-metallic material, e.g., foam. The impact-absorption device 126 extends substantially along the entire length of the bumper assembly 100 to cover the tubular members 116, 118, the middle member 124, and the mounting members 120, 122. The impact-absorption device 126 may be securely mounted to the tubular members 116, 118 and/or the middle member 124 in any suitable manner, e.g., by fasteners, welding, etc. The impact-absorption device 126 is also formed with a longitudinal curvature that corresponds to the longitudinal curvature of the tubular members 116, 118. In use, the impact-absorption device 126 dissipates energy being transmitted to the tubular members 116, 118, the middle member 124, and the space frame 114 during a vehicle collision.

Figure 37:
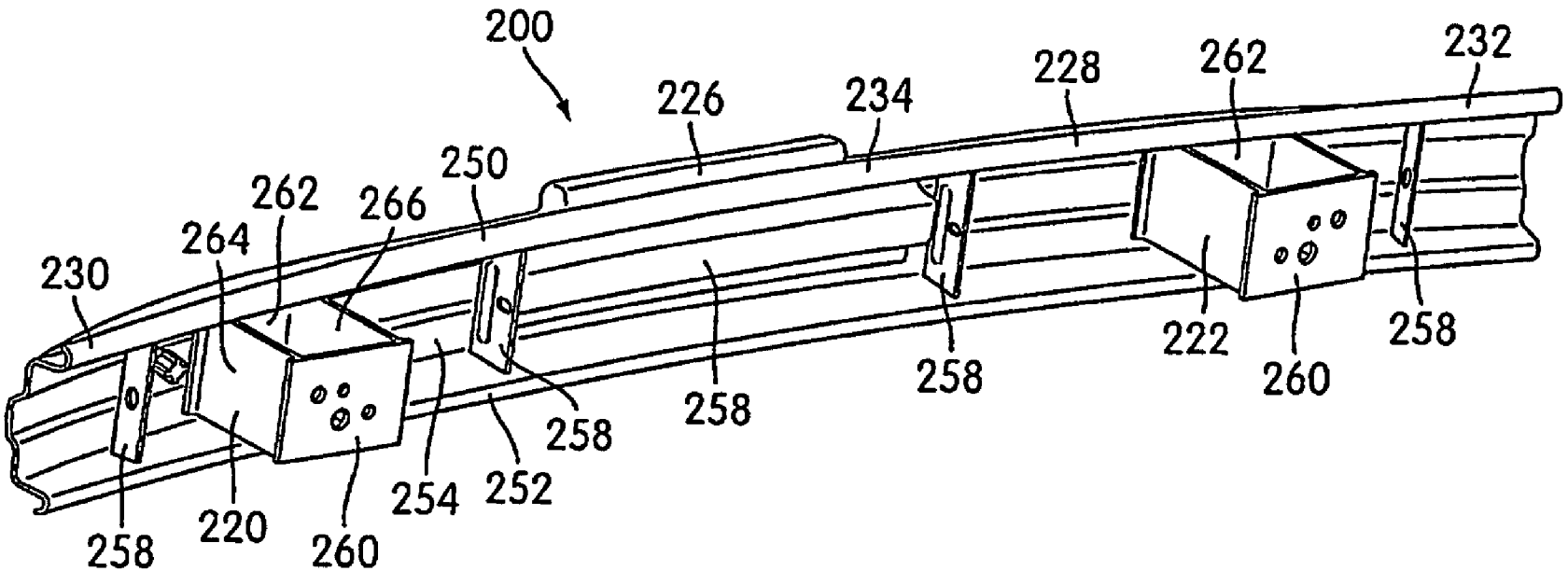
FIG. 37 is a rear perspective view illustrating another embodiment of a bumper assembly.
Figure 38:
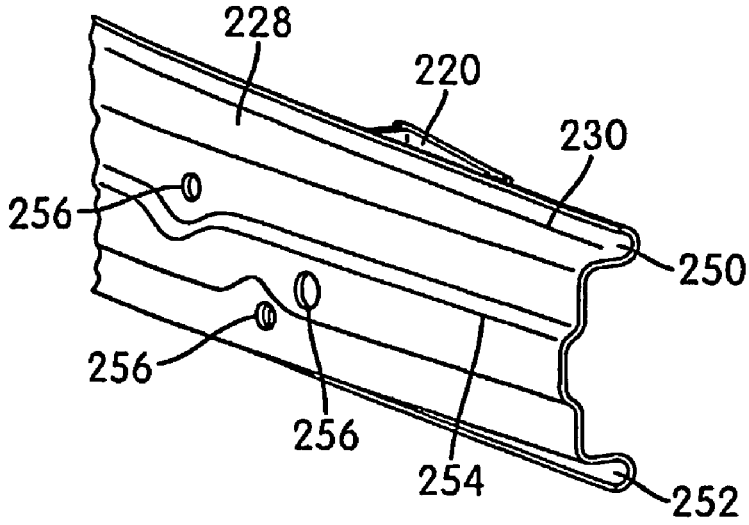
FIG. 38 is an enlarged front perspective view illustrating a mounting member of the bumper assembly shown in FIG. 37 attached to a middle member of the bumper assembly shown in FIG. 37.
Figure 39:
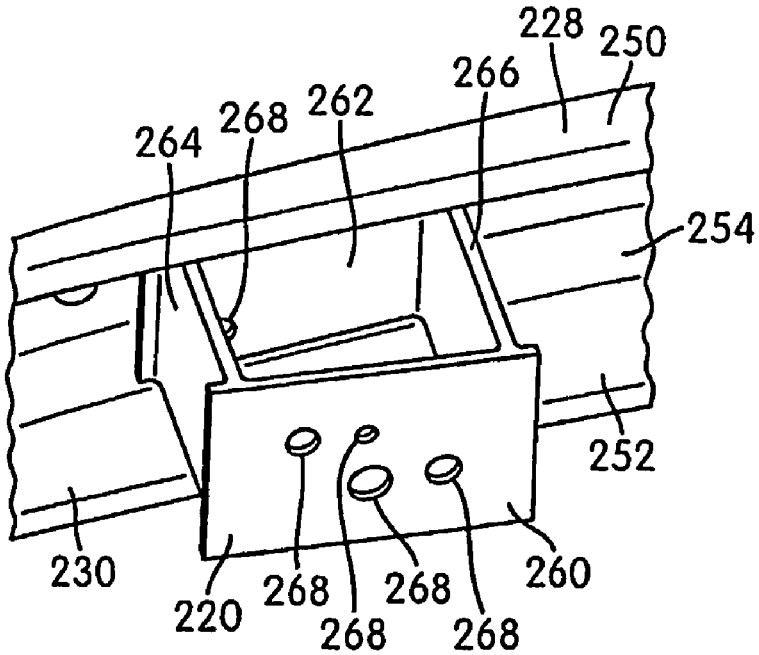
FIG. 39 is an enlarged rear perspective view illustrating a mounting member of the bumper assembly shown in FIG. 37 attached to a middle member of the bumper assembly shown in FIG. 37.

FIGS. 37-39 illustrate another embodiment of a bumper assembly 200. As illustrated, the bumper assembly 200 includes a longitudinally extending steel bumper member 228 constructed to protect the vehicle from impact, first and second aluminum mounting members 220, 222 attached to one side of the steel bumper member 228, and an impact-absorption device 226 attached to an opposite side of the steel bumper member 228.

In the illustrated embodiment, the first and second mounting members 220, 222 are rigidly mounted to the bumper member 228 in spaced-apart relation such that the bumper member 228 extends between the first and second mounting members 220, 222. Further, the first and second mounting members 220, 222 are positioned between the bumper member 228 and the vehicle space frame. The bumper assembly 200 is mounted to the space frame of the vehicle by rigidly mounting each mounting member 220, 222 to the space frame. In use, the impact absorption device 226 is positioned to receive collision forces during a front end or rear end collision. The impact absorption device 226 collapses during the collision in order to dissipate energy and thus reduce the magnitude of collision forces being transmitted to the bumper member 228 and the space frame of the vehicle.

The bumper member 228 is preferably formed from an elongated piece of sheet metal, e.g., high strength steel. The sheet metal is bent to provide a one-piece bumper member 228 with opposing end portions 230, 232 and a centrally disposed intermediate portion 234 extending between the end portions 230, 232. The sheet metal is also bent to impart a longitudinal curvature to the bumper member 228. The sheet metal may be bent into the desired shape of the bumper member 228 in any suitable manner, e.g., roll forming, stamping, hot stamping, hydroforming. Further details of the hydroforming process are provided in U.S. Pat. No. 6,092,865 to Jaekel, which is incorporated herein by reference thereto. Also, the bumper member 228 may vary in length and longitudinal curvature to suit various vehicle widths and contours.

The end portions 230, 232 and intermediate portion 234 of the bumper member 228 cooperate to define an upper wall 250, a lower wall 252, and a central wall 254 between the upper and lower walls 250, 252. As shown in FIG. 38, one or more openings 256 are provided in the central wall 254 for mounting the bumper member 228 to the impact absorption device 226 and the mounting members 220, 222. Additionally, brackets and/or stiffening members 258 are attached between the upper and lower walls 250, 252, e.g., by welding, to add rigidity/reinforcement to the bumper member 228. For example, FIG. 37 shows bracket/stiffening members 258 in the intermediate portion 234 of the bumper member 228.

The first and second aluminum mounting members 220, 222 are formed separately from the bumper beam 228 and rigidly attached thereto. In the illustrated embodiment, the mounting members 220, 222 are attached to the intermediate portion 234 of the bumper beam 228 between the end portions 230, 232. Each mounting member 220, 222 is in the form of a mounting bracket that provides mounting plates 260, 262 and connecting walls 264, 266 between the mounting plates 260, 262. The mounting plate 260 of each mounting member 220, 222 is configured to mount to the vehicle space frame, and the mounting plate 262 is configured to mount to the central wall 254 of the bumper member 228. In the illustrated embodiment, the mounting plates 260, 262 include one or more openings 268 for mounting, e.g., by fasteners. However, the mounting plates 260, 262 may be secured in position in any other suitable manner, e.g., welding. Moreover the mounting members 220, 222 may have any other suitable structure to facilitate connection to the vehicle and bumper member 228.

The first and second aluminum mounting members 220, 222 may be formed in any suitable manner, e.g., extrusion. Also, the first and second aluminum members 220, 222 may be formed with an aluminum portion and a steel portion. Moreover, the aluminum mounting members 220, 222 are connected to the steel bumper member 228 to prevent corrosion. For example, the members 220, 222, 228 may be coated with an anti-corrosive material. Additionally, the mounting members 220, 222 may be other structural members such as crush cans configured to absorb a collision force and deform in predetermined manner. For example, the connecting walls 264, 266 of each mounting member 220, 222 may be structured to deform in a predetermined manner. Additionally, the aluminum members may be made of any appropriate material that is lighter than steel (or the stronger material used for providing the strength to the bumper) and be formed as any element of the bumper assembly that can be made of a lighter material to decrease weight while maintaining other elements of the bumper assembly of a stronger material such as steel.

The impact-absorption device 226 is constructed from a non-metallic material, e.g., foam. The impact-absorption device 226 extends substantially along the entire length of the bumper member 228. The impact-absorption device 226 may be securely mounted to the bumper member 228 in any suitable manner, e.g., by fasteners or welding. The impact-absorption device 226 is also formed with a longitudinal curvature that corresponds to the longitudinal curvature of the bumper member 228. In use, the impact-absorption device 226 dissipates energy being transmitted to the bumper member 228 and the space frame during a vehicle collision.

Figure 40:
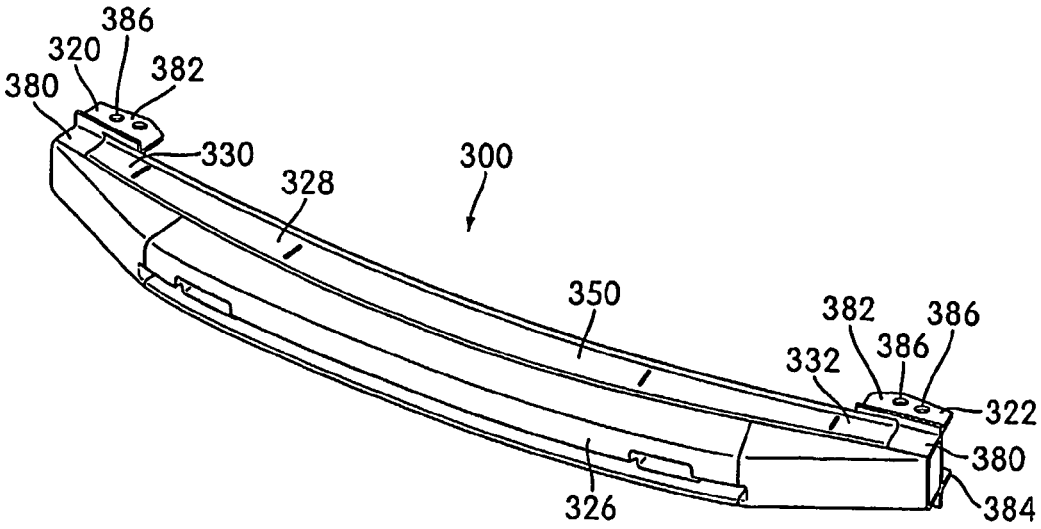
FIG. 40 is a front perspective view illustrating another embodiment of a bumper assembly.
Figure 41:
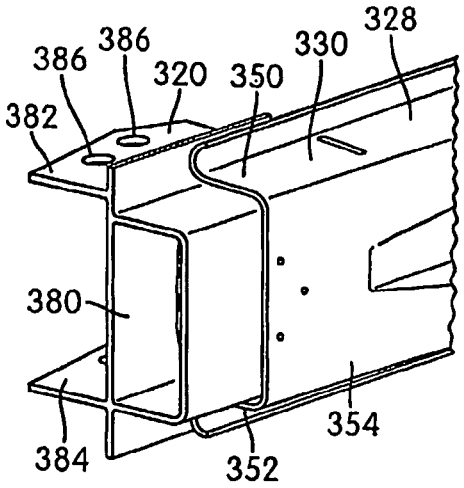
FIG. 41 is an enlarged front perspective view illustrating a mounting member of the bumper assembly shown in FIG. 40 attached to a middle member of the bumper assembly shown in FIG. 40.
Figure 42:
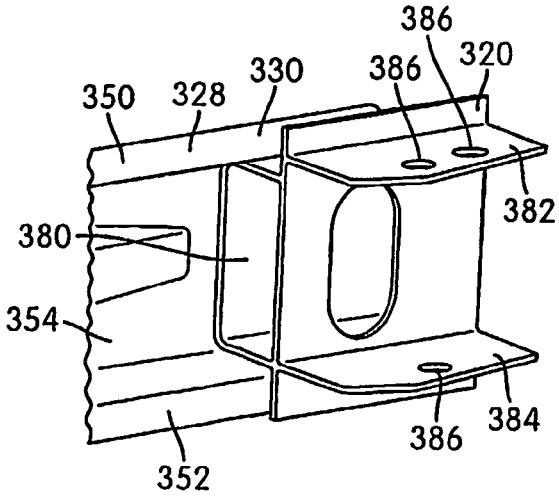
FIG. 42 is an enlarged rear perspective view illustrating a mounting member of the bumper assembly shown in FIG. 40 attached to a middle member of the bumper assembly shown in FIG. 40.

FIGS. 40-42 illustrate another embodiment of a bumper assembly 300. As illustrated, the bumper assembly 300 includes a longitudinally extending steel bumper member 328 constructed to protect the vehicle from impact, first and second aluminum mounting members 320, 322 attached to one side of the steel bumper member 328, and an impact-absorption device 326 attached to an opposite side of the steel bumper member 328.

The bumper assembly 300 is substantially similar to the bumper assembly 200. In contrast, the mounting members 320, 322 have a different configuration and are attached to end portions 330, 332 of the bumper member 328.

The first and second aluminum mounting members 320, 322 are formed separately from the bumper beam 328 and rigidly attached thereto. In the illustrated embodiment, the mounting members 320, 322 are attached to the opposing end portions 330, 332 of the bumper beam 328. Specifically, as shown in FIG. 41, each mounting member 320, 322 is attached to the bumper member 328 such that a portion of the mounting member 320, 322 is attached to the respective end portion 330, 332 and a remaining portion of the mounting member 320, 322 extends past the respective end portion 330, 332. Thus, the bumper beam 328 is cut short of the mounting area such that it is positioned inboard of the outer attachment points of the mounting members 320, 322.

Each mounting member 320, 322 is in the form of a mounting bracket that provides a tubular portion 380 and upper and lower mounting plates 382, 384 extending from the tubular portion 380. The upper and lower mounting plates 382, 384 of each mounting member 320, 322 is configured to mount to the vehicle space frame, and the tubular portion 380 is configured to mount to the bumper member 328. In the illustrated embodiment, the upper and lower mounting plates 382, 384 include one or more openings 386 for mounting, e.g., by fasteners, to the space frame. However, the mounting plates 382, 384 may be secured to the space frame in any other suitable manner, e.g., welding. The tubular portion 380 is received within the space defined by the upper, lower, and central walls 350, 352, 354 of the bumper member 328. The tubular portion 380 may be secured to the walls 350, 352, 354 by welding or in any other suitable manner. Moreover, the mounting members 320, 322 may have any other suitable structure to facilitate connection to the vehicle and bumper member 328.

Similar to the mounting members 220, 222, the mounting members 320, 322 may be formed in any suitable manner, e.g., extrusion. Also, the mounting members 320, 322 may be formed with an aluminum portion and a steel portion. Moreover, the mounting members 320, 322 are connected to the steel bumper member 328 to prevent corrosion. For example, the members 320, 322, 328 may be coated with an anti-corrosive material. Additionally, the mounting members 320, 322 may be crush cans configured to absorb a collision force and deform in predetermined manner. For example, the tubular portion 380 of each mounting member 320, 322 may be structured to deform in a predetermined manner.

Figure 43:
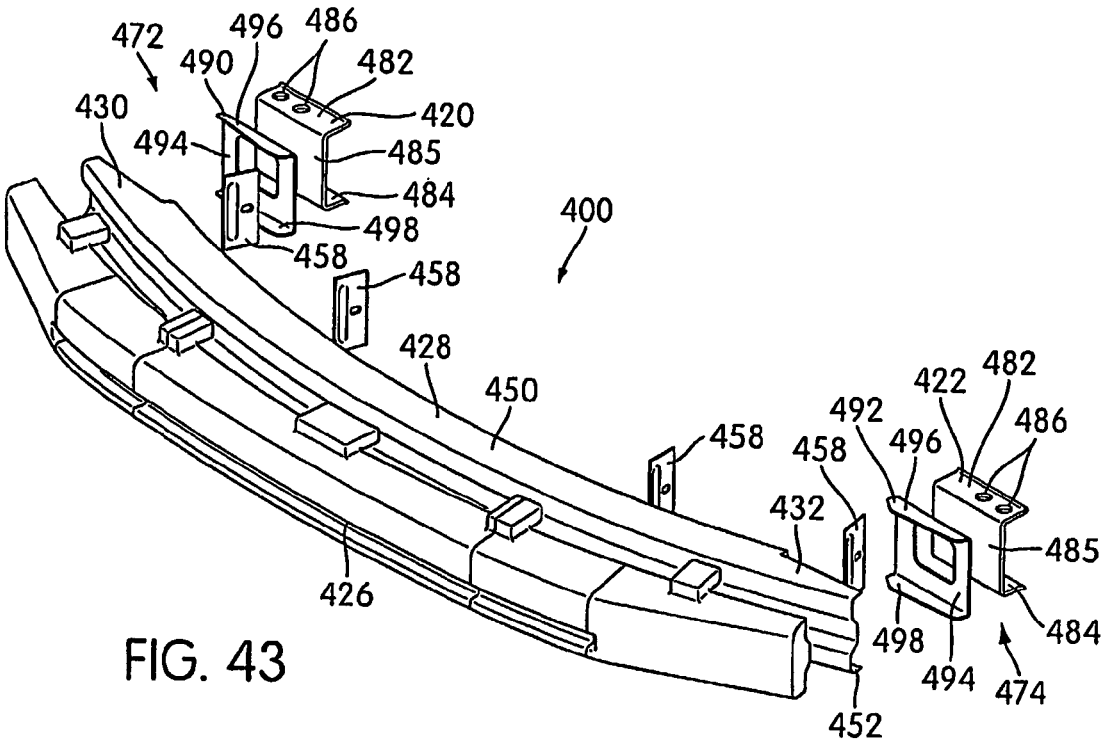
FIG. 43 is an exploded view illustrating another embodiment of a bumper assembly.
Figure 44:
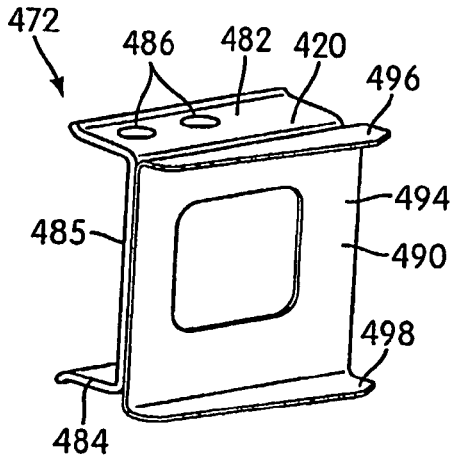
FIG. 44 is an enlarged perspective view illustrating a mounting member of the bumper assembly shown in FIG. 43 attached to a connecting member of the bumper assembly shown in FIG. 43.

FIGS. 43 and 44 illustrate another embodiment of a bumper assembly 400. As illustrated, the bumper assembly 400 includes a longitudinally extending steel bumper member 428 constructed to protect the vehicle from impact, first and second aluminum mounting members 420, 422 attached to one side of the steel bumper member 428, and an impact-absorption device 426 attached to an opposite side of the steel bumper member 428. Additionally, brackets and/or stiffening members 458 are attached to the bumper member 428, e.g., by welding, to add rigidity/reinforcement to the bumper member 428.

The bumper assembly 400 is substantially similar to the bumper assembly 200. In contrast, the mounting members 420, 422 have a different configuration and are attached to end portions 430, 432 of the bumper member 428 with connecting members 490, 492 formed of another material, e.g., a heavier material such as steel. Thus, a mounting bracket assembly 472 formed of bracket 420 and member 490 and a mounting bracket assembly 474 formed of bracket 422 and member 492, as illustrated in FIG. 44, can be used to attach the bumper assembly 400 to the space frame.

The first and second aluminum mounting members 420, 422 are formed separately from the bumper beam 428 and rigidly attached to opposing end portions 430, 432 of the bumper beam 428 by connecting members 490, 492. Each mounting member 420, 422 is in the form of a mounting bracket that provides upper and lower mounting plates 482, 484 and a connecting plate 485 extending between the upper and lower mounting plates 482, 484. The upper and lower mounting plates 482, 484 of each mounting member 420, 422 are configured to mount to the vehicle space frame, and the connecting plate 485 is configured to mount to a respective connecting member 490, 492. In the illustrated embodiment, the upper and lower mounting plates 482, 484 include one or more openings 486 for mounting, e.g., by fasteners, to the space frame. However, the mounting plates 482, 484 may be secured to the space frame in any other suitable manner, e.g., welding. The connecting plate 485 is attached to a connecting wall 494 of a respective connecting member 490, 492, e.g., by welding. The connecting member 490, 492 also includes upper and lower walls 496, 498 that are secured to the upper and lower walls 450, 452 of the bumper member 428 by welding or in any other suitable manner. Moreover, the mounting members 420, 422 and connecting members 490, 492 may have any other suitable structure to facilitate connection to the vehicle and bumper member 428.

Similar to the mounting members 220, 222 320, 322, the mounting members 420, 422 may be formed in any suitable manner, e.g., extrusion. Also, the mounting members 420, 422 may be formed with an aluminum portion and a steel portion. Moreover, the mounting members 420, 422 are connected to the steel bumper member 428 to prevent corrosion. For example, the members 420, 422, 428 may be coated with an anti-corrosive material. Additionally, the mounting members 420, 422 may be crush cans configured to absorb a collision force and deform in predetermined manner.

The bumper assemblies illustrated herein illustrate a few examples of a bumper assembly that uses a combination of heavier materials, such as steel, along with lighter materials to decrease the overall weight of the bumper assembly. In the illustrated embodiment, the lighter material is aluminum and the heavier material is steel. It should be understood that other materials can be used as desired. Also, the lighter material is illustrated primary in the form of attachments for the heavier material such as mounting brackets. However, the lighter material can be any element of the bumper assembly, for example, the lighter material can be used for things such as panels or crush cans.

While the invention has been specifically described in connection with certain specific embodiments thereof, it is to be understood that this is by way of illustration and not of limitation, and the scope of the appended claims should be construed as broadly as the prior art will permit.

What is claimed is:

1. A hybrid component for lightweight, structural uses, comprising:

a steel member; and a cast coupling member cast on a portion of said steel member by casting-in-place aluminum about said portion of said steel member, thereby positively and rigidly securing said coupling member to said steel member, wherein said portion of said steel member on which said coupling member is cast is an end portion of a tubular member including bent sections extending outwardly away from said steel member.

2. A hybrid component according to claim 1, wherein the cast-in-place aluminum is a semi-solid aluminum.

3. An engine cradle for a motor vehicle, comprising:

a frame assembly having a pair of spaced rails secured by spaced cross members;

at least one of said spaced rails and said spaced cross members including a hybrid component, including:

a steel member; and a cast coupling member cast on a portion of said steel member by casting-in-place aluminum about said portion of said steel member, thereby positively and rigidly securing said coupling member to said steel member.

4. An engine cradle according to claim 3, wherein said steel member has a yield strength of at least about 1300 MPa, and said cast coupling has a yield strength of at least about 180 MPa.

5. An engine cradle according to claim 4, wherein said steel member is a tubular member.

6. An engine cradle according to claim 3, wherein the cast-in-place aluminum is a semi-solid aluminum.

7. An engine cradle according to claim 3, wherein the cast-in-place aluminum is a semi-solid aluminum and the steel member is formed of a high strength steel.

8. A control arm for a motor vehicle, comprising:

a hybrid component including:

a steel member and curved in a longitudinal direction; and cast coupling members cast on said steel member, each of said coupling members being cast on a portion of said steel member by casting-in-place aluminum about said portion of said steel member, thereby positively and rigidly securing said coupling member to said steel member.

9. A control arm according to claim 8, wherein said steel member has a yield strength of at least about 1300 MPa, and each of said cast couplings has a yield strength of at least about 180 MPa.

10. A control arm according to claim 9, wherein said steel member is a tubular member.

11. A control arm according to claim 8, wherein the cast-in-place aluminum is a semi-solid aluminum.

12. A control arm according to claim 8, wherein the cast-in-place aluminum is a semi-solid aluminum and the steel member is formed of a high strength steel.

13. An instrument panel support structure for a motor vehicle, comprising:

a hybrid component in the form of a cross beam; and a mount positioned on each end of said hybrid component, said hybrid component including:

a steel member; and a cast coupling member cast said steel member, said coupling member being cast on a portion of said steel member by casting-in-place aluminum about said portion of said steel member, thereby positively and rigidly securing said coupling member to said steel member, said cast coupling member including a plurality of spaced brackets.

14. An instrument panel support structure according to claim 13, wherein said steel member has a yield strength of at least about 1300 MPa, and said cast coupling has a yield strength of at least about 180 MPa.

15. An instrument panel support structure according to claim 14, wherein said steel member is a tubular member.

16. An instrument panel support structure according to claim 13, wherein the cast-in-place aluminum is a semi-solid aluminum.

17. An instrument panel support structure according to claim 13, wherein the cast-in-place aluminum is a semi-solid aluminum and the steel member is formed of a high strength steel.

18. A bumper assembly for a motor vehicle, comprising:

a hybrid component including:

a steel member; and cast coupling members cast on said steel member, each of said coupling members being cast on a portion of said steel member by casting-in-place aluminum about said portion of said steel member, thereby positively and rigidly securing said coupling members to said steel member, said steel member forming a longitudinally extending steel bumper member constructed to protect the vehicle from impact, and said coupling members forming first and second aluminum members attached to said steel bumper member, wherein said steel bumper member extends between said first and second aluminum members and said first and second aluminum members are positioned between said steel bumper member and the space frame of the vehicle.

19. A bumper assembly according to claim 18, wherein said steel member has a yield strength of at least about 1300 MPa, and each of said cast couplings has a yield strength of at least about 180 MPa.

20. A bumper assembly according to claim 19, wherein said steel member is a tubular member.

21. A bumper assembly according to claim 18, wherein the cast-in-place aluminum is a semi-solid aluminum.

22. A bumper assembly according to claim 18, wherein the cast-in-place aluminum is a semi-solid aluminum and the steel member is formed of a high strength steel.

23. A method of forming a hybrid component for lightweight, structural uses, comprising:

forming a steel member into a predetermined configuration; and casting a coupling member on a portion of the steel member by casting-in-place aluminum about the portion of the steel member, thereby positively and rigidly securing the coupling member to the steel member, wherein forming the steel member includes forming the steel member to have a yield strength of at least about 1300 MPa, and casting the cast coupling includes forming the aluminum to have a yield strength of at least about 180 MPa.

24. A method according to claim 23, wherein forming the steel member includes forming the steel member as a tubular member.

25. A method according to claim 23, further comprising:

heat treating the hybrid component to an elevated temperature.

26. A method according to claim 25, wherein, the heat treating the hybrid component to an elevated temperature includes heat treating the hybrid component to approximately 440 degrees.

27. A method according to claim 23, wherein the cast-in-place aluminum is a semi-solid aluminum.

28. A method according to claim 23, wherein the cast-in-place aluminum is a semi-solid aluminum and the steel member is formed of a high strength steel.

29. A hybrid component for lightweight, structural uses, comprising:

a steel member;

a cast coupling member cast on a portion of said steel member by casting-in-place aluminum about said portion of said steel member, thereby positively and rigidly securing said coupling member to said steel member, wherein said steel member has a yield strength of at least about 1300 MPa, and said cast coupling has a yield strength of at least about 180 MPa.

30. A hybrid component according to claim 29, wherein said steel member is a tubular member.

31. A hybrid component according to claim 30, wherein said portion of said steel member on which said coupling member is cast is an end portion of said tubular member.

32. A hybrid component for lightweight, structural uses, comprising:

a steel member; and a cast coupling member cast on a portion of said steel member by casting-in-place aluminum about said portion of said steel member, thereby positively and rigidly securing said coupling member to said steel member, wherein said portion of said steel member on which said coupling member is cast is an end portion of a tubular member including a section having a non-circular cross-section.

33. A hybrid component for lightweight, structural uses, comprising:

a steel member; and a cast coupling member cast on a portion of said steel member by casting-in-place aluminum about said portion of said steel member, thereby positively and rigidly securing said coupling member to said steel member, wherein said portion of said steel member on which said coupling member is cast is a mid portion of said tubular member.

34. A hybrid component according to claim 33, wherein said mid portion includes a section having a non-circular cross-section.

* * * * *